US011781270B2

(12) United States Patent
Anderson et al.

(10) Patent No.: US 11,781,270 B2
(45) Date of Patent: Oct. 10, 2023

(54) METHODS OF MAKING MULTI-PLY FIBROUS SHEETS

(71) Applicant: GPCP IP Holdings LLC, Atlanta, GA (US)

(72) Inventors: Peter Gordon Anderson, De Pere, WI (US); Frank D. Harper, Nennah, WI (US); Nathan Capps, Appleton, WI (US)

(73) Assignee: GPCP IP Holdings LLC, Atlanta, GA (US)

( * ) Notice: Subject to any disclaimer, the term of this patent is extended or adjusted under 35 U.S.C. 154(b) by 81 days.

(21) Appl. No.: 17/321,705

(22) Filed: May 17, 2021

(65) Prior Publication Data

US 2021/0277603 A1 Sep. 9, 2021

Related U.S. Application Data

(62) Division of application No. 16/257,349, filed on Jan. 25, 2019, now Pat. No. 11,035,078.

(Continued)

(51) Int. Cl.
*D21F 11/14* (2006.01)
*D21H 21/20* (2006.01)

(Continued)

(52) U.S. Cl.
CPC ..... *D21F 11/145* (2013.01); *D21F 3/02* (2013.01); *D21F 11/006* (2013.01); *D21H 21/20* (2013.01); *D21H 27/005* (2013.01)

(58) Field of Classification Search
CPC ..... D21F 11/145; D21F 3/02; D21F 11/006; D21F 11/04; D21H 21/20; D21H 27/005;

(Continued)

(56) References Cited

U.S. PATENT DOCUMENTS 4,166,001 A 8/1979 Dunning et al.
4,486,268 A 12/1984 Nuttall et al.

(Continued)

FOREIGN PATENT DOCUMENTS

EP 0 851 950 A1 7/1998
WO 97/11227 A1 3/1997

(Continued)

OTHER PUBLICATIONS

Byrd et al., in "Considerations For The Use of Nonwood Raw Materials for Tissue Manufacture," Tissue 360° Forum at PaperCon, pp. 1-60 (Year: 2013).

*Primary Examiner* — Jose A Fortuna

(57) ABSTRACT

A method of making a fibrous sheet includes providing a first furnish including a primary pulp having papermaking fibers, the papermaking fibers (i) having a weight-weighted average fiber length between about two and seven tenths millimeters and about three millimeters, (ii) a coarseness of about sixteen milligrams per one hundred meters or lower, and (iii) being at least eighty percent of the papermaking fibers of the first furnish, forming a nascent web having at least two layers, one of the at least two layers being (i) a surface layer of the nascent web and (ii) formed from the first furnish, dewatering the nascent web to form a dewatered web, applying the surface layer of the dewatered web to the outer surface of a Yankee drum of a Yankee dryer, and drying the dewatered web with the Yankee dryer to form a fibrous sheet.

32 Claims, 9 Drawing Sheets

Related U.S. Application Data

(60) Provisional application No. 62/639,559, filed on Mar. 7, 2018.

(51) Int. Cl.
*D21F 11/00* (2006.01)
*D21H 27/00* (2006.01)
*D21F 3/02* (2006.01)

(58) Field of Classification Search
CPC ..... D21H 27/38; D21H 27/30; D21H 11/04; D21H 25/05; D21H 27/002; A61K 8/0208
See application file for complete search history.

(56) References Cited

U.S. PATENT DOCUMENTS 5,147,505 A 9/1992 Altman
5,397,435 A 3/1995 Ostendorf et al.
5,437,766 A 8/1995 Van Phan et al.
5,846,380 A 12/1998 Van Phan et al.
5,851,352 A 12/1998 Vinson et al.
5,882,479 A 3/1999 Oriaran et al.
5,932,068 A 8/1999 Farrington, Jr. et al.
5,958,187 A 9/1999 Bhat et al.
5,981,044 A 11/1999 Phan et al.
6,017,417 A 1/2000 Wendt et al.
6,017,418 A 1/2000 Oriaran et al.
6,028,018 A 2/2000 Amundson et al.
6,051,104 A 4/2000 Oriaran et al.
6,059,928 A 5/2000 Van Luu et al.
6,068,731 A 5/2000 Dwiggins et al.
6,103,063 A 8/2000 Oriaran et al.
6,113,740 A 9/2000 Oriaran et al.
6,126,784 A 10/2000 Ficke et al.
6,143,131 A 11/2000 Dwiggins et al.
6,149,769 A 11/2000 Mohammadi et al.
6,153,053 A 11/2000 Harper et al.
6,156,157 A 12/2000 Schroeder et al.
6,165,319 A 12/2000 Heath et al.
6,171,442 B1 1/2001 Farrington, Jr. et al.
6,187,141 B1 2/2001 Takeuchi et al.
6,193,838 B1 2/2001 Oriaran et al.
6,207,013 B1 3/2001 Oriaran et al.
6,241,850 B1 6/2001 Kelly
6,245,197 B1 6/2001 Oriaran et al.
6,248,212 B1 6/2001 Anderson et al.
6,273,996 B1 8/2001 Hollenberg et al.
6,277,241 B1 8/2001 Merker et al.
6,280,570 B1 8/2001 Harper et al.
6,287,421 B1 9/2001 Dwiggins et al.
6,299,728 B1 10/2001 Kurtz et al.
6,299,729 B1 10/2001 Heath et al.
6,328,849 B1 12/2001 Dwiggins et al.
6,334,931 B1 1/2002 Dwiggins et al.
6,361,651 B1 3/2002 Sun
6,365,000 B1 4/2002 Dwiggins et al.
6,379,498 B1 4/2002 Burns et al.
6,413,363 B1 7/2002 Hsu et al.
6,419,790 B1 7/2002 Leege et al.
6,423,180 B1 7/2002 Behnke et al.
6,440,267 B1 8/2002 Rekoske et al.
6,447,640 B1 9/2002 Watson et al.
6,461,476 B1 10/2002 Goulet et al.
6,464,830 B1 10/2002 Holz et al.
6,468,392 B2 10/2002 Oriarian et al.
6,488,812 B2 12/2002 Shannon et al.
6,494,993 B1 12/2002 Suonpera
6,511,579 B1 1/2003 Edwards et al.
6,517,673 B1 2/2003 Heath et al.
6,547,928 B2 4/2003 Bamholtz et al.
6,558,511 B2 5/2003 Dwiggins et al.
6,565,707 B2 5/2003 Behnke et al.
6,582,560 B2 6/2003 Runge et al.
6,607,635 B2 8/2003 Bakken et al.
6,607,636 B2 8/2003 Ross et al.
6,607,637 B1 8/2003 Vinson et al.
6,649,024 B2 11/2003 Oriarian et al.
6,649,025 B2 11/2003 Mills et al.
6,673,203 B1 1/2004 Neal, Jr. et al.
6,699,360 B2 3/2004 Heath et al.
6,709,550 B2 3/2004 Holz et al.
6,727,004 B2 4/2004 Goulet et al.
6,752,905 B2 6/2004 Hu et al.
6,758,943 B2 7/2004 McConnell et al.
6,797,114 B2 9/2004 Hu
6,797,117 B1 9/2004 McKay et al.
6,808,790 B2 10/2004 Chen et al.
6,808,791 B2 10/2004 Curro et al.
6,821,387 B2 11/2004 Hu
6,821,388 B2 11/2004 Marsh
6,827,818 B2 12/2004 Farrington, Jr. et al.
6,837,972 B2 1/2005 Marsh
6,846,383 B2 1/2005 Firimacco
6,849,157 B2 2/2005 Farrington, Jr. et al.
6,855,229 B2 2/2005 McKay et al.
6,861,380 B2 3/2005 Garnier et al.
6,887,350 B2 5/2005 Garnier et al.
6,918,993 B2 7/2005 Tirimacco
6,929,714 B2 8/2005 Hu et al.
6,946,058 B2 9/2005 Hu
6,949,166 B2 9/2005 Bakken et al.
6,964,725 B2 11/2005 Shannon et al.
6,969,443 B1 11/2005 Kokko
7,012,058 B2 3/2006 Nguyen
7,041,197 B2 5/2006 Kokko et al.
7,156,954 B2 1/2007 Farrington, Jr. et al.
7,217,340 B2 5/2007 Nguyen
7,258,764 B2 8/2007 Mauler
7,282,116 B2 10/2007 Vinson et al.
7,294,230 B2 11/2007 Flugge-Berendes et al.
7,311,853 B2 12/2007 Vinson et al.
7,361,253 B2 4/2008 Tirimacco
7,377,995 B2 5/2008 Chen et al.
7,387,702 B2 6/2008 Norlander
7,396,593 B2 7/2008 Liu et al.
7,422,658 B2 9/2008 Hermans et al.
7,429,307 B2 9/2008 Soderberg
7,494,563 B2 2/2009 Edwards et al.
7,585,392 B2 9/2009 Kokko et al.
7,648,772 B2 1/2010 Gran et al.
7,736,464 B2 6/2010 Kokko
7,736,465 B2 6/2010 Ryan et al.
7,744,723 B2 6/2010 Sheehan et al.
7,749,355 B2 7/2010 Knobloch et al.
7,749,356 B2 7/2010 Runge et al.
7,767,059 B2 8/2010 Ryan et al.
7,794,565 B2 9/2010 Shannon et al.
7,794,566 B2 9/2010 Edwards et al.
7,820,874 B2 10/2010 Manifold et al.
7,867,362 B2 1/2011 Allen et al.
7,879,189 B2 2/2011 Dyer et al.
7,879,190 B2 2/2011 Dyer et al.
7,879,191 B2 2/2011 Dyer et al.
7,897,011 B2 3/2011 Peng et al.
7,951,266 B2 5/2011 Kokko et al.
7,985,321 B2 7/2011 Sumnicht et al.
RE42,968 E 11/2011 Sheehan et al.
8,057,636 B2 11/2011 Vinson et al.
8,066,849 B2 11/2011 Kokko et al.
8,070,914 B2 12/2011 Ryan et al.
8,142,615 B2 3/2012 Wildlock et al.
8,257,551 B2 9/2012 Beuther et al.
8,313,613 B2 11/2012 Matsumura et al.
8,425,724 B2 4/2013 Ryan et al.
8,512,517 B2 8/2013 Nordstrom
8,518,214 B2 8/2013 Furman, Jr. et al.
8,535,482 B2 9/2013 Jiang et al.
8,608,905 B2 12/2013 Leskela et al.
8,771,467 B2 7/2014 Fang
8,834,677 B2 9/2014 Tirimacco et al.
8,871,060 B2 10/2014 Klerelid
8,877,008 B2 11/2014 Dwiggins et al.
8,968,517 B2 3/2015 Ramaratnam et al.
9,005,738 B2 4/2015 Baker et al.

(56) References Cited

U.S. PATENT DOCUMENTS

| | | | | |
|---|---|---|---|---|
| 9,045,863 | B2 | 6/2015 | Dwiggins et al. | |
| 9,045,864 | B2 | 6/2015 | Dwiggins et al. | |
| 9,127,408 | B2 | 9/2015 | Qin et al. | |
| 9,309,627 | B2 | 4/2016 | Miller et al. | |
| 9,382,666 | B2 | 7/2016 | Ramaratnam et al. | |
| 9,410,291 | B2 | 8/2016 | Shannon | |
| 9,441,328 | B2 | 9/2016 | Dwiggins et al. | |
| 9,447,546 | B2 | 9/2016 | Goulet et al. | |
| 9,458,573 | B2 | 10/2016 | Barnholtz et al. | |
| 9,493,911 | B2 | 11/2016 | Miller et al. | |
| 9,597,862 | B2 | 3/2017 | Kelly et al. | |
| 9,661,974 | B2 | 5/2017 | Baker et al. | |
| 9,688,055 | B2 | 6/2017 | Graff et al. | |
| 9,702,089 | B2 | 7/2017 | Ramaratnam et al. | |
| 9,702,090 | B2 | 7/2017 | Ramaratnam et al. | |
| 9,719,213 | B2 | 8/2017 | Miller, IV et al. | |
| 9,783,934 | B2 | 10/2017 | Dwiggins et al. | |
| 9,896,804 | B2 | 2/2018 | Goulet et al. | |
| 10,132,041 | B2 | 11/2018 | Hermans et al. | |
| 10,138,601 | B2 | 11/2018 | Sze et al. | |
| 11,035,078 | B2 * | 6/2021 | Anderson | D21H 27/38 |
| 11,053,643 | B2 * | 7/2021 | Rouse | D21F 11/04 |
| 2002/0134520 | A1 | 9/2002 | Behnke et al. | |
| 2003/0121627 | A1 | 7/2003 | Hu et al. | |
| 2004/0163782 | A1 | 8/2004 | Hernandez-Munoa et al. | |
| 2005/0028955 | A1 | 2/2005 | Winslow | |
| 2005/0028956 | A1 | 2/2005 | Winslow | |
| 2005/0090789 | A1 | 4/2005 | Graef et al. | |
| 2005/0139338 | A1 | 6/2005 | Shibatani et al. | |
| 2005/0214335 | A1 * | 9/2005 | Allen | D21H 21/20 162/158 |
| 2005/0241791 | A1 | 11/2005 | Wolkowicz et al. | |
| 2005/0252626 | A1 | 11/2005 | Chen et al. | |
| 2007/0020315 | A1 | 1/2007 | Shannon et al. | |
| 2007/0232179 | A1 | 10/2007 | Polat et al. | |
| 2008/0268205 | A1 | 10/2008 | Vogel et al. | |
| 2010/0000693 | A1 | 1/2010 | Champ et al. | |
| 2010/0040825 | A1 | 2/2010 | Mainfold et al. | |
| 2010/0151174 | A1 | 6/2010 | Graff et al. | |
| 2011/0104970 | A1 | 5/2011 | Barnholtz et al. | |
| 2013/0186580 | A1 | 7/2013 | Kavalew et al. | |
| 2015/0231867 | A1 | 8/2015 | Kelly et al. | |
| 2015/0233060 | A1 | 8/2015 | Polat et al. | |
| 2015/0330029 | A1 | 11/2015 | Ramaratnam et al. | |
| 2016/0138224 | A1 | 5/2016 | Shannon et al. | |
| 2016/0145810 | A1 | 5/2016 | Miller, IV et al. | |
| 2016/0160448 | A1 | 6/2016 | Miller, IV et al. | |
| 2016/0183758 | A1 | 6/2016 | Baker et al. | |
| 2016/0237624 | A1 | 8/2016 | Jiang et al. | |
| 2016/0244916 | A1 | 8/2016 | Neogi et al. | |
| 2016/0289897 | A1 | 10/2016 | Ramaratnam et al. | |
| 2016/0289898 | A1 | 10/2016 | Ramaratnam et al. | |
| 2016/0333530 | A1 | 11/2016 | Dwiggins et al. | |
| 2016/0355986 | A1 | 12/2016 | Goulet et al. | |
| 2016/0362843 | A1 | 12/2016 | Hermans et al. | |
| 2017/0089013 | A1 | 3/2017 | Sze et al. | |
| 2018/0044859 | A1 | 2/2018 | Hermans et al. | |
| 2019/0004025 | A1 | 1/2019 | Witkowski | |
| 2019/0169799 | A1 | 6/2019 | Neogi et al. | |
| 2019/0276985 | A1 * | 9/2019 | Anderson | D21F 11/145 |
| 2020/0270813 | A1 * | 8/2020 | Rekoske | D21F 11/006 |
| 2021/0277603 | A1 * | 9/2021 | Anderson | D21H 21/20 |

FOREIGN PATENT DOCUMENTS

| | | | |
|---|---|---|---|
| WO | 00/39394 | A1 | 7/2000 |
| WO | 02/14606 | A2 | 2/2002 |
| WO | 2005/073462 | A1 | 8/2005 |
| WO | 2008/003343 | A1 | 1/2008 |
| WO | 2008/045770 | A2 | 4/2008 |
| WO | 2008/068658 | A2 | 6/2008 |
| WO | 2009/130383 | A2 | 10/2009 |
| WO | 2010/113849 | A1 | 10/2010 |
| WO | 2011/039325 | A2 | 4/2011 |
| WO | 2012/086374 | A1 | 6/2012 |
| WO | 2013/017344 | A1 | 2/2013 |
| WO | 2016/122477 | A1 | 8/2016 |

* cited by examiner

METHODS OF MAKING MULTI-PLY FIBROUS SHEETS

CROSS REFERENCE TO RELATED APPLICATION

This application is a divisional of U.S. patent application Ser. No. 16/257,349, filed Jan. 25, 2019, now U.S. Pat. No. 11,035,078, issued Jun. 15, 2021, which claims the benefit of priority of U.S. Provisional Patent Application No. 62/639,559, filed Mar. 7, 2018, each of which is hereby incorporated by reference in its entirety.

FIELD OF THE INVENTION

Our invention relates to paper products, such as paper towels, and methods of making the same. In particular, our invention relates to paper products that have a reduced level of lint generated during use and methods of making such paper products.

BACKGROUND OF THE INVENTION

Consumer preference for paper towels is driven by various different attributes of the paper product. Typical attributes that may impact consumer preference include, for example, dry strength, wet strength, softness, absorbency, and hand-feel of the paper product. Another attribute that can impact consumer preference for paper towels is the amount of lint produced by the product during use. Paper towels are often nonwoven paper products that comprise paper making fibers. As the paper towels are wiped, or otherwise rubbed, on a surface, some of the fibers in the paper product are released or slough off from the paper product. These released fibers are referred to as lint. Generally, high levels of lint generated during use of a towel product are undesirable for consumers. Therefore, strategies that can be employed in papermaking that can reduce the level of lint generated during product usage could provide a competitive advantage for towel manufacturers. Lint reduction strategies that maintain consumer desired levels of other attributes, such as dry strength, wet strength, softness, absorbency, and hand-feel, are particularly desired.

SUMMARY OF THE INVENTION

According to one aspect, our invention relates to a paper product including a first stratified base sheet and a second stratified base sheet. The first stratified base sheet has at least two layers. One of the at least two layers is an inner layer, and another of the at least two layers is an outer layer comprising papermaking fibers. At least about eighty percent of the papermaking fibers in the outer layer are softwood fibers. The softwood fibers of the outer layer have (i) a weight-weighted average fiber length between about two and seven tenths millimeters and about three millimeters and (ii) a coarseness of about sixteen milligrams per one hundred meters or lower. The second stratified base sheet has at least two layers. One of the at least two layers is an inner layer attached to the inner layer of the first stratified base sheet, and another of the at least two layers is an outer layer comprising papermaking fibers. At least about eighty percent of the papermaking fibers in the outer layer are softwood fibers. The softwood fibers of the outer layer have (i) a weight-weighted average fiber length between about two and seven tenths millimeters and about three millimeters and (ii) a coarseness of about sixteen milligrams per one hundred meters or lower. The paper product has a CD wet/dry tensile ratio between about twenty-five hundredths and about thirty-five hundredths.

According to another aspect, our invention relates to a paper product including a first stratified base sheet and a second stratified base sheet. The first stratified base sheet has at least two layers. One of the at least two layers is an inner layer, and another of the at least two layers is an outer layer comprising papermaking fibers. Less than about twenty percent of the papermaking fibers in the outer layer are hardwood fibers and the remainder are northern softwood fibers. The second stratified base sheet has at least two layers. One of the at least two layers is an inner layer attached to the inner layer of the first stratified base sheet, and another of the at least two layers is an outer layer comprising papermaking fibers. Less than about twenty percent of the papermaking fibers in the outer layer are hardwood fibers and the remainder are northern softwood fibers. The paper product has a CD wet/dry tensile ratio between about twenty-five hundredths and about thirty-five hundredths.

According to a further aspect, our invention relates to a method of making a fibrous sheet. The method includes providing a first furnish including a primary pulp having papermaking fibers. The papermaking fibers of the primary pulp (i) have a weight-weighted average fiber length between about two and seven tenths millimeters and about three millimeters, (ii) a coarseness of about sixteen milligrams per one hundred meters or lower, and (iii) are at least eighty percent of the papermaking fibers of the first furnish. The method also includes forming a nascent web having at least two layers. One of the at least two layers is (i) a surface layer of the nascent web and (ii) formed from the first furnish. The method further includes dewatering the nascent web to form a dewatered web, applying the surface layer of the dewatered web to the outer surface of a Yankee drum of a Yankee dryer, and drying the dewatered web with the Yankee dryer to form a fibrous sheet.

According to still another aspect, our invention relates to a method of making a fibrous sheet. The method includes forming a nascent web having at least two layers. Each of the layers are formed from an aqueous slurry of papermaking fibers, and one of the at least two layers is a surface layer of the nascent web. Less than about eighty percent of the papermaking fibers in the aqueous slurry of papermaking fibers forming the surface layer are hardwood fibers with the remainder being northern softwood fibers. The method also includes dewatering the nascent web to form a dewatered web, applying the surface layer of the dewatered web to the outer surface of a Yankee drum of a Yankee dryer, and drying the dewatered web with the Yankee dryer to form a fibrous sheet.

According to yet another aspect, our invention relates to a method of making a fibrous sheet. The method includes forming a nascent web from an aqueous slurry of papermaking fibers and dewatering the nascent web to form a dewatered web. The method also includes applying the dewatered web to the outer surface of a Yankee drum of a Yankee dryer, and drying the dewatered web with the Yankee dryer to form a dried web. The method further includes removing the dried web from the outer surface of the Yankee drum using a doctor blade. The doctor blade has a beveled top surface that is beveled from about five degrees to about thirty degrees.

These and other aspects of our invention will become apparent from the following disclosure.

BRIEF DESCRIPTION OF THE DRAWINGS

FIG. 1A is a schematic of a two-ply paper product formed from two two-layer base sheets. FIG. 1B is a schematic of a two-ply paper product formed from two three-layer base sheets.

DESCRIPTION OF THE PREFERRED EMBODIMENTS

Figure 1A:
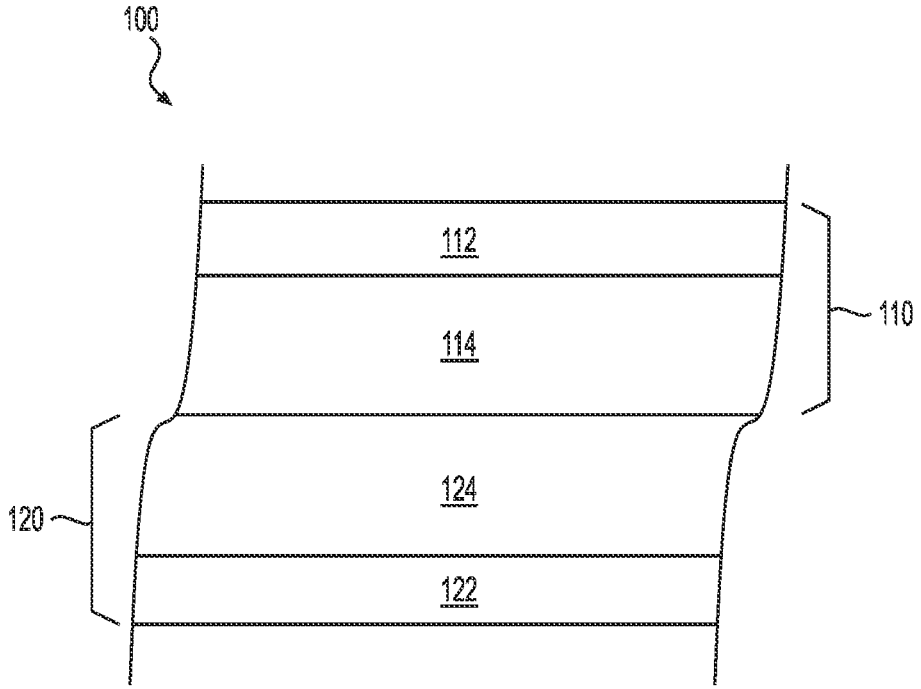
FIGS. 1A and 1B are schematic diagrams of a two-ply paper product according to preferred embodiments of our invention.

We will describe embodiments of our invention in detail below with reference to the accompanying figures. Throughout the specification and accompanying drawings, the same reference numerals will be used to refer to the same or similar components or features.

The term "paper product," as used herein, encompasses any product incorporating papermaking fibers. This would include, for example, products marketed as paper towels and napkins.

Papermaking fibers used to form the paper products of our invention include cellulosic fibers commonly referred to as wood pulp fibers, liberated in pulping process from softwood (gymnosperms or coniferous trees) and hardwoods (angiosperms or deciduous trees). However, the papermaking fibers are not so limited and may also include cellulosic fibers from diverse material origins, including non-woody fibers liberated from sugar cane, bagasse, sabai grass, rice straw, banana leaves, paper mulberry (i.e., bast fiber), abaca leaves, pineapple leaves, esparto grass leaves, and fibers from the genus Hesperaloe in the family Agavaceae. For example, these papermaking fibers include also virgin pulps or recycle (secondary) cellulosic fibers, or fiber mixes comprising at least fifty-one percent cellulosic fibers. Such cellulosic fibers may include both wood and non-wood fibers. Preferred papermaking fibers that may be used for the paper products of our invention will be discussed further below.

"Furnishes" and like terminology refers to aqueous compositions including papermaking fibers, and, optionally, wet strength resins, debonders, and the like, for making paper products. The composition of preferred furnishes that can be used in embodiments of our invention will be discussed further below. As used herein, the initial fiber and liquid mixture (or furnish) that is dried to a finished product in a papermaking process will be referred to as a "web," "paper web," a "cellulosic sheet," and/or a "fibrous sheet." The finished product may also be referred to as a "paper product," a "cellulosic sheet" and/or a "fibrous sheet." In addition, other modifiers may variously be used to describe the web at a particular point in the papermaking machine or process. For example, the web may also be referred to as a "nascent web," a "moist nascent web," a "molded web," and a "dried web."

When describing our invention, the terms "machine direction" (MD) and "cross-machine direction" (CD) will be used in accordance with their well-understood meaning in the art. That is, the MD of a fabric, a roll, or other structure refers to the direction that the structure moves on a papermaking machine in a papermaking process, while the CD refers to a direction perpendicular the MD of the structure.

To manufacture the paper products of our invention, a fibrous sheet, referred to herein as a base sheet, is first produced on a paper making machine. The base sheets of our invention are multi-layer (stratified) base sheets having at least two layers. One layer is referred to herein as the "Yankee layer" (for reasons that will be described later) or the outer layer, and the other layer is referred to herein as the air layer or inner layer. In base sheets having more than two layers, the Yankee layer and the air layer are the outer most layers of the base sheet, and additional layers may be formed between them. In a three-layer base sheet, for example, a middle layer is located between the Yankee layer and the air layer. Although the strategies to reduce lint discussed below may be implemented on base sheets that are homogenous, using a stratified base sheet helps the paper product achieve other properties, such as dry strength, wet strength, softness, absorbency, and hand-feel for example, that are in desirable ranges for consumers in addition to low lint. Multiple base sheets may then be combined on a converting line to form a multi-ply paper product. For example, FIG. 1A is a schematic of a two-ply paper product 100 formed from two two-layer base sheets, a first base sheet 110 and a second base sheet 120. Each of the base sheets 110, 120 has a Yankee layer 112, 122 and an air layer 114, 124. On the converting line, the air layers 114, 124 are glued to each other thus forming the inner layers of the paper product 100. As a result, the Yankee layers 112, 122 are the outer layers of the paper product 100. The outer layers of the paper product 100 are the layers that will come into contact with surfaces during use, and thus the outer layers may also be referred to herein as contact layers.

Figure 1B:
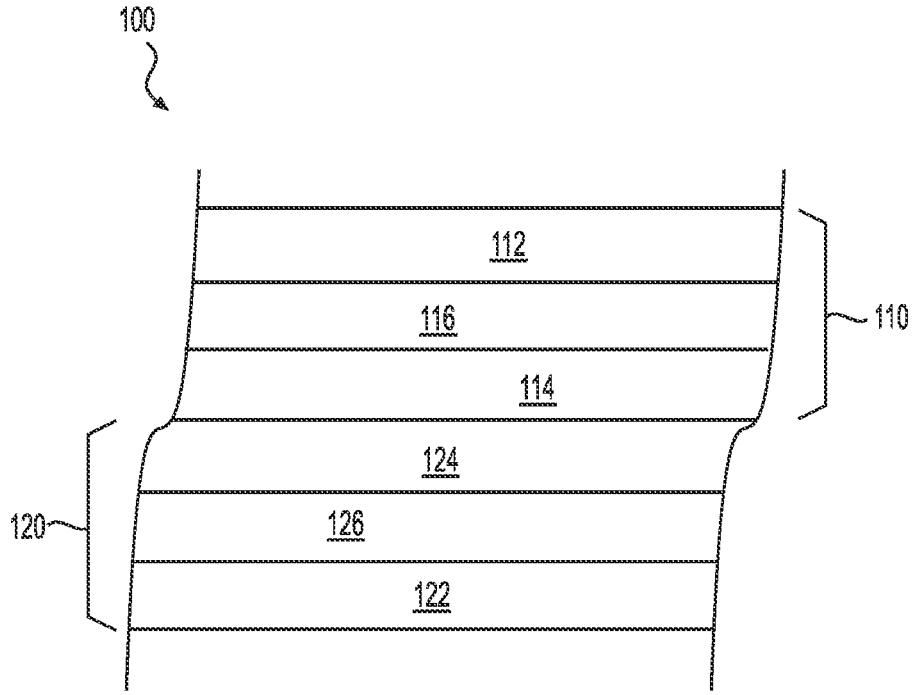

The same relative orientation of the base sheets 110, 120 may be used when the base sheets comprise more than two layers. For example, FIG. 1B is a schematic of a two-ply paper product 100 formed from two three-layer base sheets. Each of the base sheets 110, 120 has a Yankee layer 112, 122, an air layer 114, 124, and a middle layer 116, 126. On the converting line, the air layers 114, 124 are glued to each other, resulting in the Yankee layers 112, 122 being the outer layers of the paper product 100.

We have found that overall lint levels produced by a paper product during use are directly related to the tensile strength of the paper product. Without intending to be bound by any theory, we believe that a stronger sheet results in higher cohesion of the contact layer from which less fiber can escape during use, reducing the amount of fiber that deposits on a surface as lint. Consequently, we believe that generating additional strength or preserving the nascent strength of the Yankee layer 112, 122 has the effect of decreasing lint generation during use. By preferentially strengthening only the Yankee layers 112, 122 (i.e., strengthening the contact surfaces of the paper product 100), the softness reduction typically associated with bulk strength increases is attenuated.

Both changes to the manufacturing process and changes to the composition and chemistry of the furnish used for the Yankee layer 112, 122 may be used to preferentially strengthen the contact layer. In the embodiments discussed herein, there are five different strategies that are employed to preferentially strengthen the contact layer. Although each of these strategies is discussed separately below, the inventive sheets and methods are not so limited. Instead, various combinations of each of these strategies may be used to produce a base sheet 110, 120 and paper product 100.

In embodiments discussed herein, we have found that the Yankee layer 112, 122 is preferably at least thirty percent of the base sheet 110, 120 (measured in terms of weight ratio). The Yankee layer is also preferably less than fifty percent of the base sheet 110, 120 (measured in terms of weight ratio). More preferably, Yankee layer is between about thirty percent and forty-five percent of the base sheet 110, 120 by weight. When three layers are used to form a base sheet 110, 120 (as shown in FIG. 1B), the Yankee layer 112, 122 may be about a third of the base sheet 110, 120 by weight.

The strategies for reducing lint discussed herein are particularly useful for paper products, such as towel products, where a consumer will find the presence of lint undesirable. The embodiments discussed herein are thus particularly useful when used with furnish chemistries that result in a paper product having a CD wet/dry tensile ratio that is preferably between about twenty-five hundredths and about thirty-five hundredths, and that is more preferably between about twenty-five hundredths and about thirty hundredths. The CD wet/dry tensile ratio is a ratio of the wet tensile strength in the CD direction of a sample to the dry tensile strength in the CD direction of a sample. Suitable CD wet/dry tensile ratios for the paper product, such as paper towels, may be achieved by adding a permanent wet strength resin to one or more of the furnishes used to create the layers of the base sheet, for example. Any suitable permanent wet strength resin known in the art may be used. For the furnishes discussed herein (particularly furnishes used for the Yankee layer 112, 122), between about five pounds per ton to about twenty pounds per ton of permanent wet strength resin is preferably added to the furnish and more preferably between about eight pounds per ton to about sixteen pounds per ton of permanent wet strength resin is added to the furnish. One strategy to reduce lint is to remove short fibers from the Yankee (contact) layer 112, 122. Short fibers as used herein are fibers having a weight-weighted average fiber length ($L_z$) of less than two millimeters. The Yankee layer 112, 122 is preferably made primarily from a pulp (referred to herein as a primary pulp) in which the papermaking fibers of the pulp have a weight-weighted average fiber length ($L_z$) of two millimeters or greater. In our investigations to date, we have achieved desirable reductions in lint from paper products made with primary pulps having a weight-weighted average fiber length ($L_z$) preferably between about two and seven tenths millimeters and about three millimeters, and more preferably between about two and seven tenths millimeters and about two and ninety-five hundredths millimeters. The weight-weighted average fiber length ($L_z$) may be calculated by grouping the fibers in a sample in classes and using the following equation:

$$L_z = \frac{\sum_i n_i l_i^3}{\sum_i n_i l_i^2}$$

where $n_i$ is the number of fibers in the i-th class and is the mean length of the i-th class.

As discussed above, lint reduction strategies that provide consumer desired levels of other attributes, such as dry strength, wet strength, softness, absorbency, and handfeel, are particularly desired. In our investigations to date, we have found that primary pulps having a coarseness of about sixteen milligrams per one hundred meters or lower produced paper products with relatively low lint, while providing consumer desired levels of other attributes, such as desirable softness values. From our investigations, the primary pulp used to form the Yankee layer 112, 122 preferably has a coarseness of about sixteen milligrams per one hundred meters or lower, more preferably about fifteen milligrams per one hundred meters or lower, and even more preferably about fourteen milligrams per one hundred meters or lower. We have also found that paper products produced with Yankee layer 112, 122 comprised of blends of hardwood species like eucalyptus or alder and having a coarseness of about ten milligrams per one hundred meters produce a relatively high amount of lint. Based on our investigations to date, we thus expect that the most beneficial reductions in lint will occur with primary pulps having a coarseness of about twelve milligrams per one hundred meters or higher. With this expectation, the primary pulps used to form the Yankee layer 112, 122 may preferably have a coarseness between about sixteen milligrams per one hundred meters and about twelve milligrams per one hundred meters, more preferably about between about fifteen milligrams per one hundred meters and about twelve milligrams per one hundred meters, and even more preferably between about fourteen milligrams per one hundred meters and about twelve milligrams per one hundred meters. The weight-weighted average fiber length ($L_z$) and coarseness may be measured by a suitable fiber quality analyzer, such as the FQA-360 made by OpTest Equipment Inc. of Hawkesbury, Ontario, Canada.

As discussed above, a variety of papermaking fibers can be used in our invention and these papermaking fibers are not limited to wood, as non-wood fibers may also be used as the primary pulp. We have found that suitable pulps used as the primary pulp include those made from softwood pulps, particularly northern softwood pulps. Fibers in softwood pulps, particularly northern softwood pulps, are typically longer than pulps consisting of, for example, hardwood fibers or eucalyptus fibers. Suitable softwood pulps may include Fir (*Abies* sp), Hemlock (*Tsuga* sp), and Spruce (*Picea* sp). Some species of Pine (*Pinus* sp), especially those commonly referred to as northern or hard pine (e.g. *Pinus strobus*—White pine, or *Pinus contorta*—Lodgepole pine), may also be suitable as they typically have fiber lengths and coarseness values in the preferred range. Southern pines (e.g. *Pinus palustris*—Longleaf pine, *Pinus echinata*—Shortleaf pine, or *Pinus taeda*—Loblolly pine), however, are typically higher in fiber coarseness and thus less suitable for use as the primary pulp. Douglas Fir (*Pseudotsuga menziesii*) also tends to have coarseness values higher than the preferred range and is thus also less suitable for use and the primary pulp.

Most preferably, the Yankee layer 112, 122 will be made from one hundred percent of the primary pulp. Fiber blends, however, may also be used in the Yankee layer 112, 122. Suitable fiber blends include blending the primary pulp with one or more secondary pulps. Any suitable secondary pulp may be used. When secondary pulps having fibers shorter than the primary pulp, particularly secondary pulps having short fibers (e.g., hardwood pulps or eucalyptus pulps), are used, the secondary pulps preferably comprises less than twenty percent and more preferably, less than five percent of the papermaking fibers of the Yankee layer 112, 122. The pulps used in the Yankee layer 112, 122 as the primary and secondary pulps may be made using the kraft process and may thus be northern softwood kraft fibers, for example.

The other layers including the air layer 114, 124 and the middle layer 116, 126 may use any suitable papermaking fiber and pulp. For example, the middle layer 116, 126 may comprise mill broke fibers and the air layer may comprise heavily refined southern softwood fibers. Additional example fiber compositions for the air layer 114, 124 are used with examples discussed below.

As discussed above and again without intending to be bound by any theory, the inventors believe that increased cohesion of the contact layer results in reduced lint levels. Once such way to increase the cohesion is to increase the degree of fiber fibrillation to result in a greater degree of bonding of the fibers and fibrils. Thus, a second strategy to reduce lint production is to refine the papermaking fibers in the Yankee layer 112, 122. Preferably, when the Yankee layer 112, 122 comprises a blend of a primary pulp, such as softwood kraft (SWK) fibers, and a secondary pulp, such as hardwood kraft (HWK) fibers, the fibers of the primary pulp are refined, and the fibers of the secondary pulp are left unrefined. When the primary pulp is refined, the refined primary pulp preferably has a Canadian Standard Freeness ("CSF") that is at least fifty milliliters less than the primary pulp in its unrefined condition. CSF (also referred to as freeness) may be determined in accordance with TAPPI Standard T 227 OM-94 (Canadian Standard Method).

A third strategy to reduce lint production is to add a wet strength resin to the Yankee layer 112, 122. Any suitable wet strength resin may be used including either a permanent wet strength resin or a temporary wet strength resin. We have found that adding the wet strength resin to the furnish even in a small amount (e.g., less than or equal to about four pounds per ton) can reduce the lint produced when the paper product 100 is used both wet and dry. When temporary wet strength resin is used, it may be preferably only added to the Yankee layer 112, 122 and the other layers, such as the air layer 114, 124, may be substantially free of the temporary wet strength resin.

Figure 2:
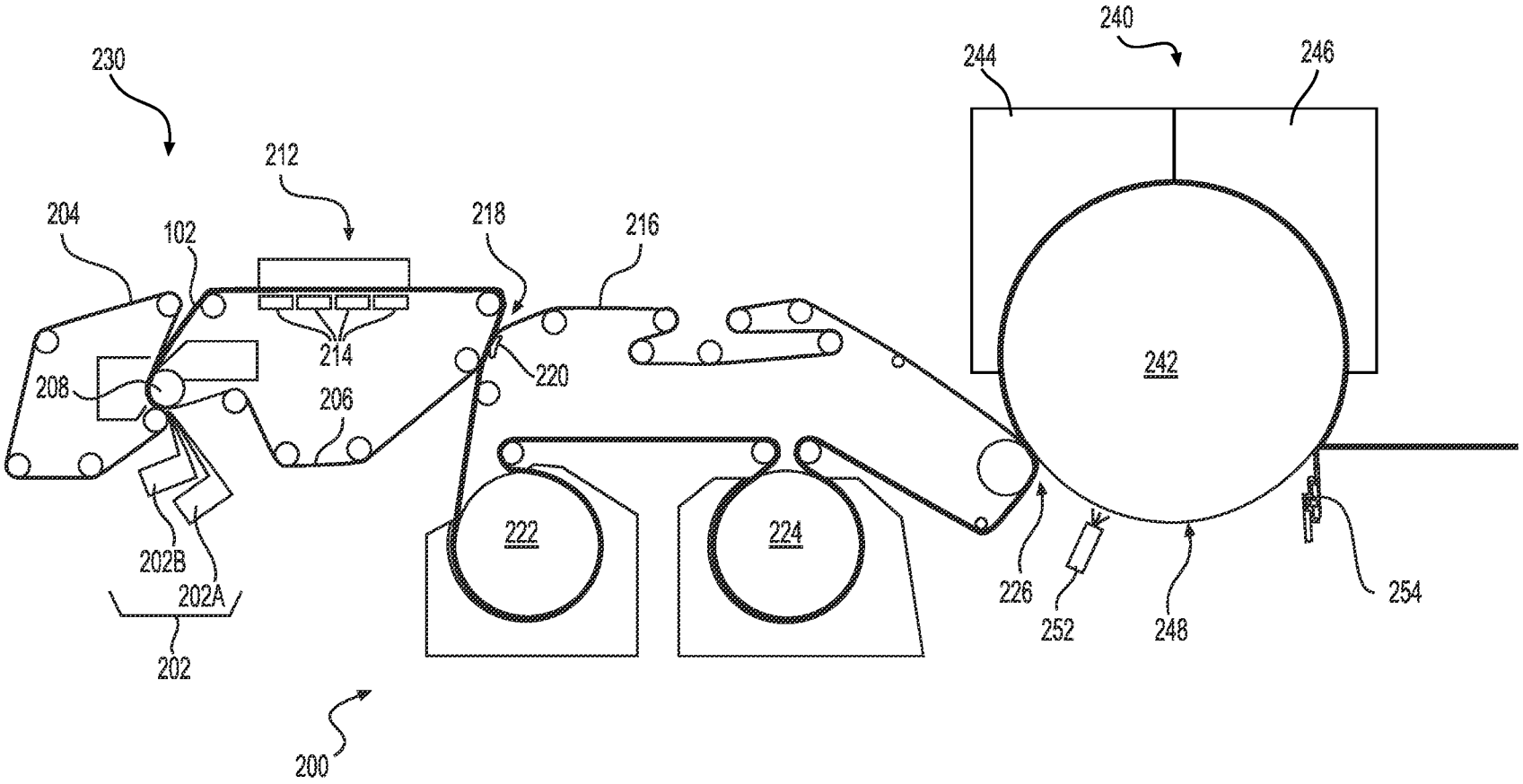
FIG. 2 is a schematic diagram of a papermaking machine that may be used according to a preferred embodiment of our invention.
Figure 3:
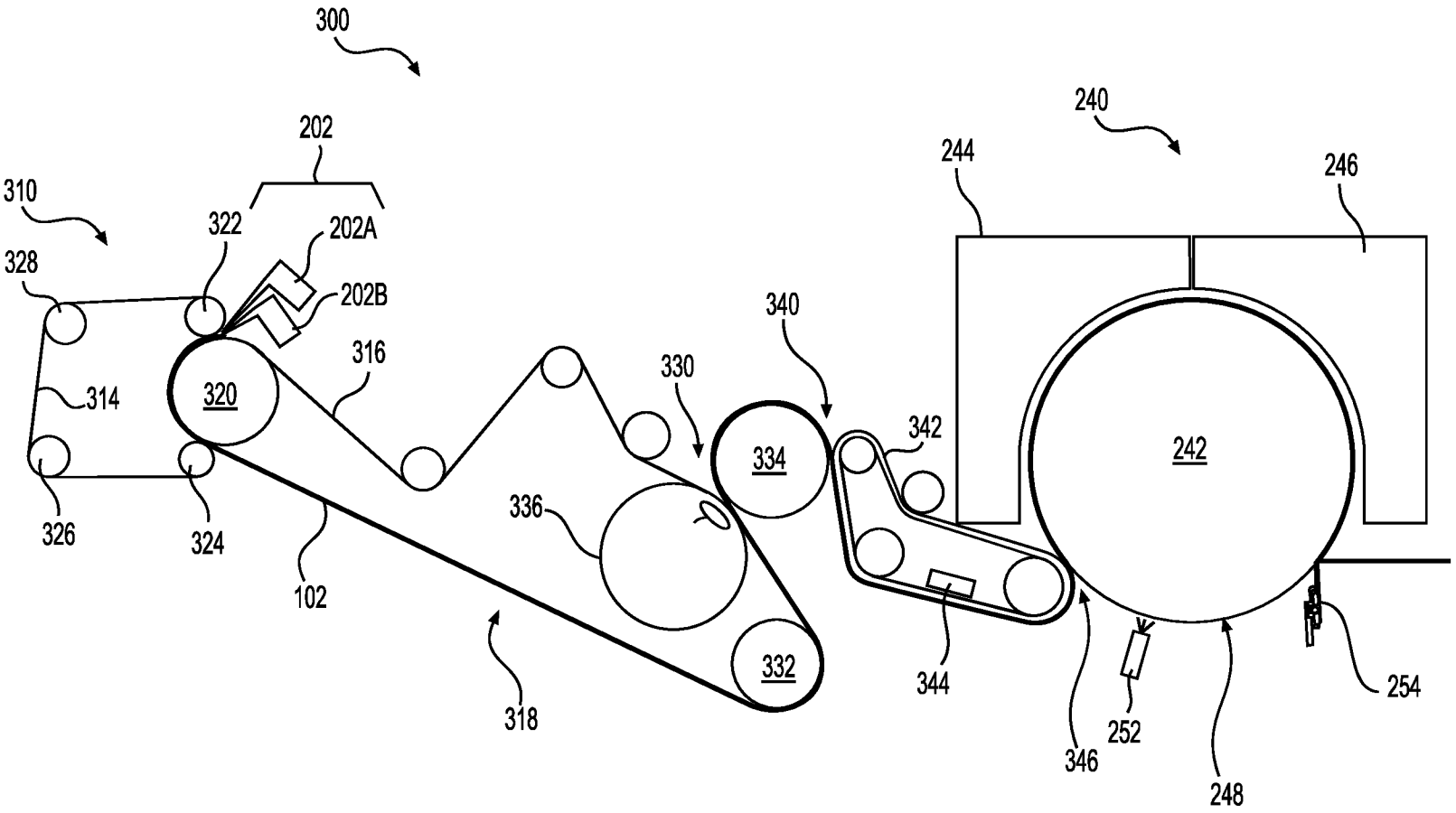
FIG. 3 is a schematic diagram of another papermaking machine that may be used according to a preferred embodiment of our invention.

The fourth and fifth strategies discussed herein are modifications and refinements to the method of manufacturing the base sheet 110, 120 on the papermaking machine. The paper products 100 discussed herein are preferably formed by methods such as through-air-drying ("TAD") or by a fabric (or belt) creping process. FIG. 2 is a schematic of a TAD papermaking machine 200. FIG. 3 is a schematic of a papermaking machine 300 used for fabric creping. Any suitable process and papermaking machine may be used, however, including, for example, conventional wet pressing with a stratified headbox.

Turning first to the TAD papermaking process described with reference to the TAD papermaking machine 200 shown in FIG. 2, the papermaking machine 200 has a forming section 230, which, in this embodiment is a twin-wire forming section. The furnish is initially supplied in the papermaking machine 200 through a headbox 202. The furnish is directed by the headbox 202 into a nip formed between a first forming fabric 204 and a second forming fabric 206, ahead of forming roll 208. The headbox 202 is a stratified headbox that, in this embodiment, has two different headbox chambers 202A, 202B. The different headbox chambers 202A, 202B can be used to provide two different jets of two different furnishes from the headbox chambers 202A, 202B into the nip formed between the first forming fabric 204 and the second forming fabric 206 to form a stratified nascent web 102. The base sheet 110, 120 resulting from the papermaking process will thus have two distinct layers, with the two layers, by and large, reflecting the different compositions of the two furnishes. Additional headbox chambers and jets can be used when forming base sheets 110, 120 having more than two layers.

The first forming fabric 204 and the second forming fabric 206 move in continuous loops and diverge after passing beyond forming roll 208. Vacuum elements such as vacuum boxes, or foil elements (not shown) can be employed in the divergent zone to both dewater the sheet and to ensure that the sheet stays adhered to second forming fabric 206. After separating from the first forming fabric 204, the second forming fabric 206 and web 102 pass through an additional dewatering zone 212 in which suction boxes 214 remove moisture from the web 102 and second forming fabric 206, thereby increasing the consistency of the web 102 from, for example, about ten percent solids to about twenty-eight percent solids. Hot air may also be used in dewatering zone 212 to improve dewatering. The web 102 is then transferred to a through-air drying (TAD) fabric 216 at transfer nip 218, where a shoe 220 presses the TAD fabric 216 against the second forming fabric 206. In some TAD papermaking machines, the shoe 220 is a vacuum shoe that applies a vacuum to assist in the transfer of the web 102 to the TAD fabric 216. Additionally, so-called rush transfer may be used to transfer the web 102 in transfer nip 218. Rush transfer may also help structure the web 102. Rush transfer occurs when the second forming fabric 206 travels at a speed that is faster than the speed of the TAD fabric 216.

The TAD fabric 216 carrying the web 102 next passes around through-air dryers 222, 224 where hot air is forced through the web to increase the consistency of the paper web 102, from about twenty-eight percent solids to about eighty percent solids. The web 102 is then further dried in a Yankee dryer section 240. The Yankee dryer section 240 comprises, for example, a steam filled drum 242 ("Yankee drum") and hot air dryer hoods 244, 246 to further dry the web 102. The web 102 is deposited on the Yankee drum 242 at a low-intensity press nip 226. A creping coating may be applied to the outer surface 248 of the Yankee drum 242 by a nozzle 252 to help the web 102 adhere to the Yankee drum 242. As the Yankee drum 242 rotates, the web 102 may be removed from the Yankee drum 242 by a doctor blade 254 where it is then wound on a reel (not shown) to form a parent roll (not shown). The reel may be operated slower than the Yankee drum 242 in order to impart a further crepe to the web 102. Removing the web 102 from the Yankee drum 242 with the doctor blade 254 may be referred to as dry creping.

The layer in the web 102 produced by headbox chamber 202A is the Yankee layer 112, 122 because, as the web 102 travels through the papermaking machine 200, this layer will be the layer in contact with the outer surface 248 of the Yankee drum 242. The other layer of the web 102 produced by headbox chamber 202B is the air layer 114, 124 because this layer is an outside layer of the web 102 not in contact with the outer surface 248 of the Yankee drum 242.

Turning now to the fabric creping process, the following is a brief summary of the papermaking process for forming the base sheet 110, 120 using papermaking machine 300 shown in FIG. 3. A detailed description of the configuration and operation of papermaking machine 300 can be found in commonly-assigned U.S. Pat. No. 7,494,563, the disclosure of which is incorporated by reference herein in its entirety.

The papermaking machine 300 has a forming section 310. In this embodiment, the forming section 310 is a crescent former, but any number of suitable forming sections, including, for example, twin wire forming sections, and suction breast roll forming sections, may be used. The forming section 310 includes headbox 202, which is a stratified headbox similar to that discussed above with reference to FIG. 2. In this embodiment, the headbox 202 deposits two stratified layers of aqueous furnishes between a forming fabric 314 and a papermaking felt 316, thereby initially forming a stratified, nascent web 102. The forming fabric 314 is supported by rolls 322, 324, 326, and 328. In the forming section 310, the papermaking felt 316 is supported by a forming roll 320. The nascent web 102 will typically leave the forming section 310 with a consistency from about ten percent to about fifteen percent (percent solids). The nascent web 102 is transferred by the papermaking felt 316 along a felt run 318 that extends about a suction turning roll 332 to a press nip 330.

The press nip 330 is formed between a backing roll 334 and an extended nip press 336. The extended nip press 336 is used to press the web 102 concurrently with the transfer of the web 102 from the papermaking felt 316 to the backing roll 334. Any suitable extended nip press 336 may be used including, for example, a ViscoNip® press made by Valmet of Espoo, Finland. Pressing the nascent web 102 increases the solids content of the nascent web 102 to form a moist nascent web 102. The preferable consistency of the moist nascent web 102 may vary depending upon the desired application. In this embodiment, the nascent web 102 is dewatered to form a moist nascent web 102 having a consistency preferably, between about twenty percent solids and about seventy percent solids, more preferably, between about thirty percent solids to about sixty percent solids, and even more preferably, between about forty percent solids to about fifty-five percent solids.

The web 102 is then carried by the backing roll 334 and deposited on a structuring fabric 342 in a creping nip 340. In other embodiments, however, instead of being transferred on the backing roll 334, the web 102 may be transferred from the felt run 318 onto an endless belt in a dewatering nip, with the endless belt then carrying the web 102 to the creping nip 340. An example of such a configuration can be seen in U.S. Pat. No. 8,871,060, which is incorporated by reference herein in its entirety.

It generally is desirable to perform a rush transfer of the web 102 from the backing roll 334 to the structuring fabric 342 in order to facilitate fabric crepe at the structuring fabric 342 and to further improve sheet bulk and softness. During a rush transfer, the structuring fabric 342 is traveling at a slower speed than the speed of the web 102 on the backing roll 334. Among other things, rush transferring redistributes the paper web 102 on the structuring fabric 392 to impart structure to the paper web 102 to increase bulk, and to effect transfer to the structuring fabric 342. After the web 102 has been deposited on the structuring fabric 39, the web 102 is then vacuum drawn by vacuum molding box 344. Any suitable structuring fabric 342 may be used, including, for example, the structuring fabric 342 shown and described in U.S. Application Pub. No. 2017/0089013, which is incorporated by reference herein in its entirety. Instead of a structuring fabric 342, other suitable structuring surfaces may be used including, for example, a belt.

After, this creping operation, the web 102 is deposited on the Yankee drum 242 in the Yankee dryer section 240 at a low-intensity press nip 346. The web 102 is dried and subsequently processed in the Yankee dryer section 240 in a similar manner to the drying and processing discussed above with reference to FIG. 2.

Again without intending to be bound by any theory, we believe that dry creping the web 102 from the outer surface 248 of the Yankee drum 242 with the doctor blade 254 can preferentially weaken the Yankee layer 112, 122, resulting in lint production during use. Consequently, the two manufacturing process related strategies to reduce lint production relate to dry creping. The creping coating applied by the nozzle 252 onto the outer surface 248 of the Yankee drum 242 can impact the amount of disruption in the Yankee layer 112, 122. Typical creping coating chemistries include a creping adhesive, a modifier, and wetting agent. Adding an additional modifying agent to attenuate the dry adhesion of the creping coating results in a reduction of lint. Preferably, the modifying agent not only imparts a shift in the dry adhesion of the creping coating, but also, it reduces the dry tack (or increases softness) of the creping coating.

Figure 4:
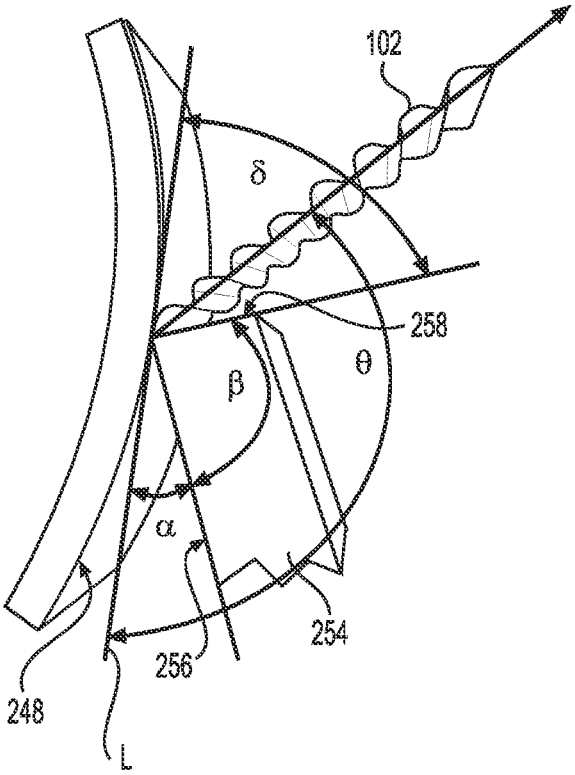
FIG. 4 is a detailed view of a portion of the papermaking machines shown in FIGS. 2 and 3.

Also, without intending to be bound by any theory, we believe that the geometry of the doctor blade 254, in particular, the blade angle, can also impact the disruption of the Yankee layer 112, 122. FIG. 4 is a detailed view of the location at which the doctor blade 254 contacts the outer surface 248 of the Yankee drum 242. A reference line L is a line tangent to the outer surface 248 of the Yankee drum 242 at the point where the doctor blade 254 contacts the outer surface 248. Angle $\alpha$ is the angle that a trailing side surface 256 of the doctor blade 254 forms relative to line L and may be considered to be the angle of the doctor blade 254. In this embodiment, angle $\alpha$ is preferably from about five degrees to twenty-five degrees, and more preferably, from about ten degrees to twenty degrees. Angle β is the angle formed between the trailing side surface 256 of the doctor blade 254 and a top surface 258 of the doctor blade. The bevel of the doctor blade 254 can be calculated by subtracting angle β from ninety degrees. The pocket angle is angle δ, which can be calculated by subtracting angles α and β from one hundred eighty degrees. We have found that increasing the pocket angle δ, particularly, by increasing the bevel of the doctor blade 254 (decreasing angle β) reduces the amount of lint produced. In this embodiment, angle β is preferably from about sixty degrees to eighty-five degrees, and more preferably from about sixty degrees to seventy-five degrees. Angle δ is preferably from about seventy degrees to one hundred ten degrees, and more preferably, from about eighty degrees to ninety-five degrees. Angle θ is the angle the web 102 leaves the outer surface 248 of the Yankee drum 242 and is the angle between line L and the web 102.

EXAMPLES

We created paper towel product implementing each of the five strategies discussed above (Examples 1 through 5). We compared the amount of lint produced by using the paper towel product produced in Examples 1 through 5 against a paper towel product used as a comparative example. Implementing each of the strategies discussed above, as demonstrated by the examples produced, reduced the amount of lint produced relative to the comparative example. Although specific examples are given below, the invention is not so limited. For example, the examples below were produced with specific structuring fabrics and additives using the fabric creping processed discussed above, but other suitable structuring fabrics and additives (or even processes such as TAD) may be used.

All of the example paper towel products, including the comparative example, were produced using the fabric creping process discussed above with reference to FIG. 3. Each of the base sheets 110, 120 were two-layer stratified base sheets. For the comparative example and Examples 1-4, the base sheets 110, 120 were formed using R-90S structuring fabric made by Voith Fabrics of Appleton, Wis. Example 5, and what will be referred to herein as a modified comparative example used an MXX structuring belt made by Albany International of Rochester, N.H. instead of the structuring fabric used for the comparative example and Examples 1-4.

Figure 5:
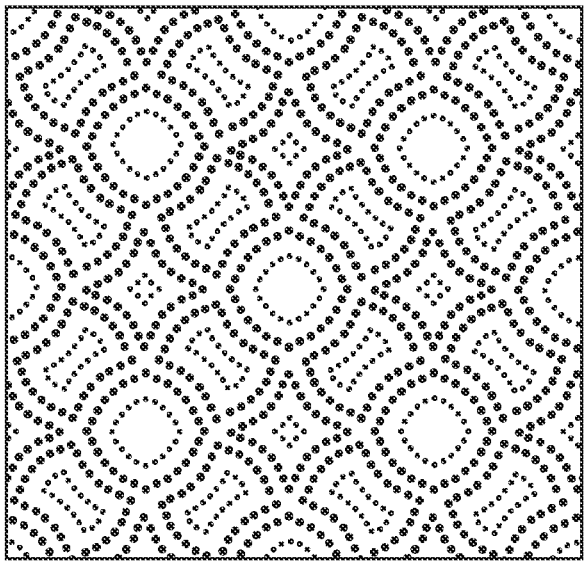
FIG. 5 shows an embossing pattern that can be used with example paper products prepared according to preferred embodiments of our invention.

Twelve pounds per ton of a permanent wet strength resin (Georgia-Pacific Amres® 1110E) and four pounds per ton of a starch (carboxymethyl cellulose (CMC), namely, Gelycel® made by Ametex Chemicals of Lombard, Ill.) were added to the furnish and were split between the two sheet layers in proportion to the fraction of the total furnish in each layer. A two-ply paper towel product 100 was produced by combining two base sheets 110, 120 as discussed above with reference to FIG. 1A. The outer ply of the paper towel product 100 was embossed on the converting line with the embossing pattern shown in FIG. 5. The inner ply remained unembossed.

All of the example paper towel products were tested for various physical properties including, geometric mean tensile strength, wet lint, and dry lint. The geometric mean tensile strength is calculated by taking the square root of the product of the MD and CD tensile strengths. The wet lint test is described in U.S. Patent Application No. 62/527,677 filed Jun. 30, 2017, the disclosure of which is incorporated by reference herein in its entirety. The dry lint test is briefly summarized below after examples and results are discussed.

Comparative Example

In the comparative example, the Yankee layer 112, 122 constituted thirty-five percent of the total base sheet 110, 120. The Yankee layer 112, 122 was composed of a blend of papermaking fibers, sixty percent northern softwood kraft (SWK) and forty percent eucalyptus hardwood kraft (HWK). The papermaking fibers in the base sheet 110, 120 were unrefined.

The air layer 114, 124 constituted the remaining sixty-five percent of the total base sheet 110, 120. The air layer 114, 124 was composed of a blend of papermaking fibers, having eighty percent northern SWK fibers and twenty percent eucalyptus HWK fibers. Base sheets 110, 120 were produced at three levels of strength, with the overall sheet strength being controlled by refining of the entire air layer 114, 124.

Example 1

In the first example, the Yankee layer 112, 122 constituted thirty-five percent of the total base sheet 110, 120 and was composed of one hundred percent of northern SWK. The air layer 114, 124 constituted the remaining sixty-five percent of the total base sheet. The air layer 114, 124 was composed of a blend of papermaking fibers, having fifty-five percent northern SWK fibers and forty-five percent eucalyptus HWK fibers. Base sheets 110, 120 were produced at three levels of strength, with the overall sheet strength being controlled by refining of the entire air layer 114, 124. The Yankee layer 112, 122 was unrefined.

Figure 6:
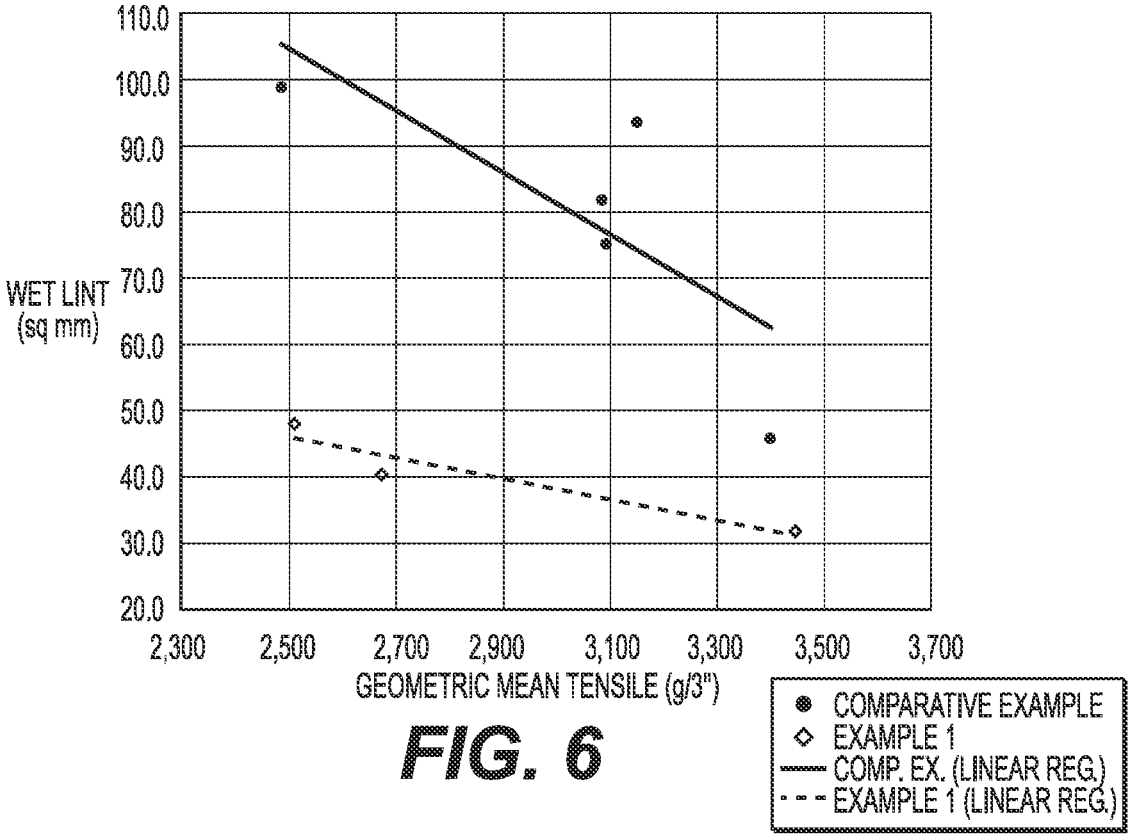
FIG. 6 is a plot of lint measurements (measured using the wet lint test) for the paper products of the comparative example and Example 1 as a function of geometric mean tensile strength.
Figure 7:
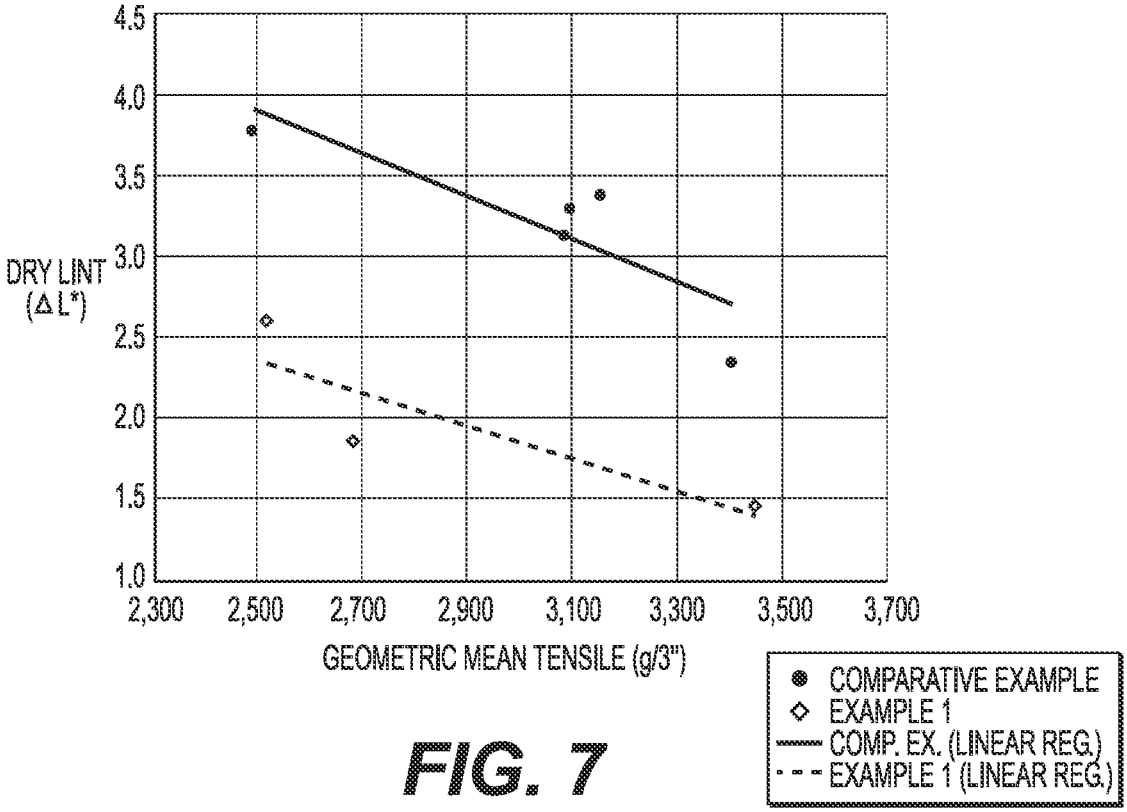
FIG. 7 is a plot of lint measurements (measured using the dry lint test) for the paper products of the comparative example and Example 1 as a function of geometric mean tensile strength.

The test results of the physical properties testing are shown in FIGS. 6 and 7, which plot the wet and dry lint, respectively, of the comparative example and Example 1 as a function of geometric mean tensile strength. A linear regression for each of the data sets is also shown in FIGS. 6 and 7. The results indicate that the products in Example 1 (produced using a one hundred percent northern SWK Yankee layer 112, 122) had wet lint values (FIG. 6) that were typically about one-half of those seen for the paper products 100 made using an SWK/HWK blend in the Yankee layer 112, 122. A similar reduction in the dry lint values (FIG. 7) are also seen, where the products in Example 1 (produced using a one hundred percent northern SWK Yankee layer 112, 122) exhibited about thirty-five percent to fifty percent lower dry lint values than did the paper products 100 made from base sheets 110, 120 whose Yankee layer 112, 122 was composed of the SWK/HWK blend.

Example 2

In the second example, the Yankee layer 112, 122 constituted thirty-five percent of the total base sheet 110, 120. The Yankee layer 112, 122 was composed of a blend of papermaking fibers, having sixty percent northern SWK fibers and forty percent Eucalyptus HWK fibers. The air layer 114, 124 constituted the remaining sixty-five percent of the total base sheet 110, 120. The air layer 114, 124 was composed of a blend of papermaking fibers, having eighty percent northern SWK fibers and twenty percent eucalyptus HWK fibers. Unlike the comparative example, the SWK in both the Yankee layer 112, 122 and the air layer 114, 124 was refined, while the HWK in both layers was left unrefined. The base sheets 110, 120 were produced at two levels of strength.

Figure 8:
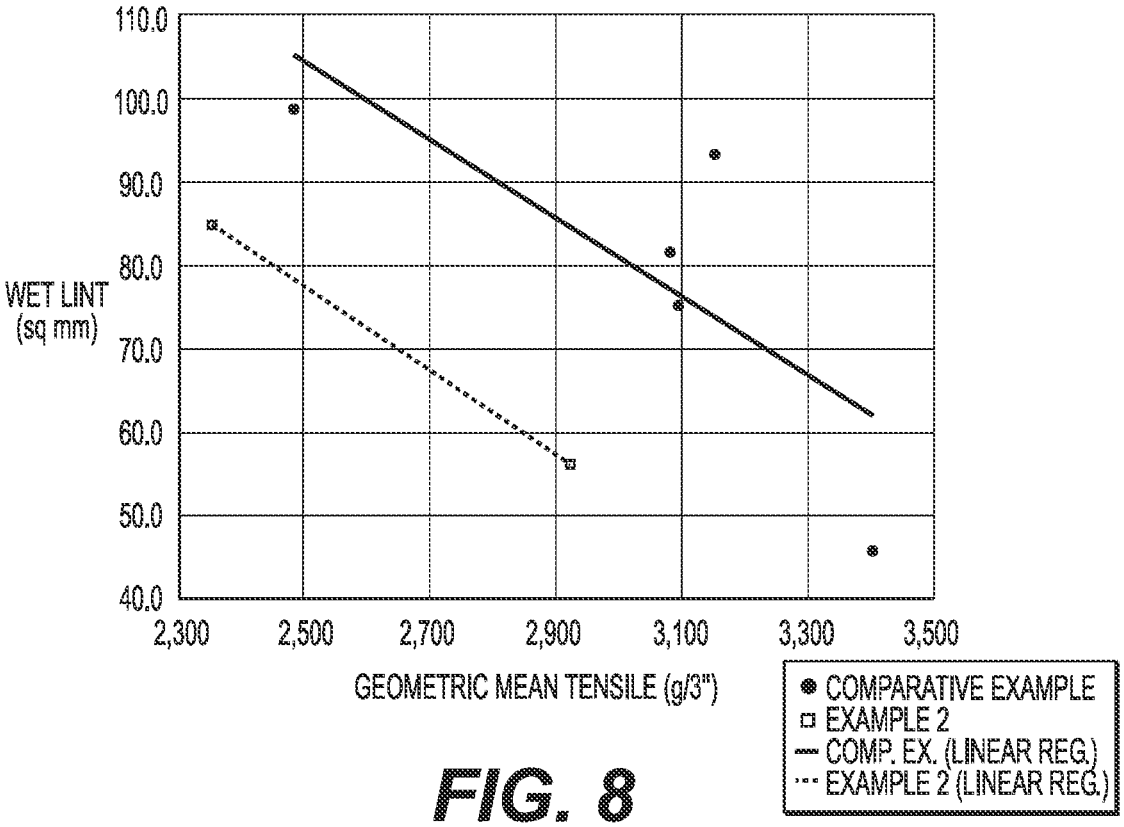
FIG. 8 is a plot of lint measurements (measured using the wet lint test) for the paper products of the comparative example and Example 2 as a function of geometric mean tensile strength.
Figure 9:
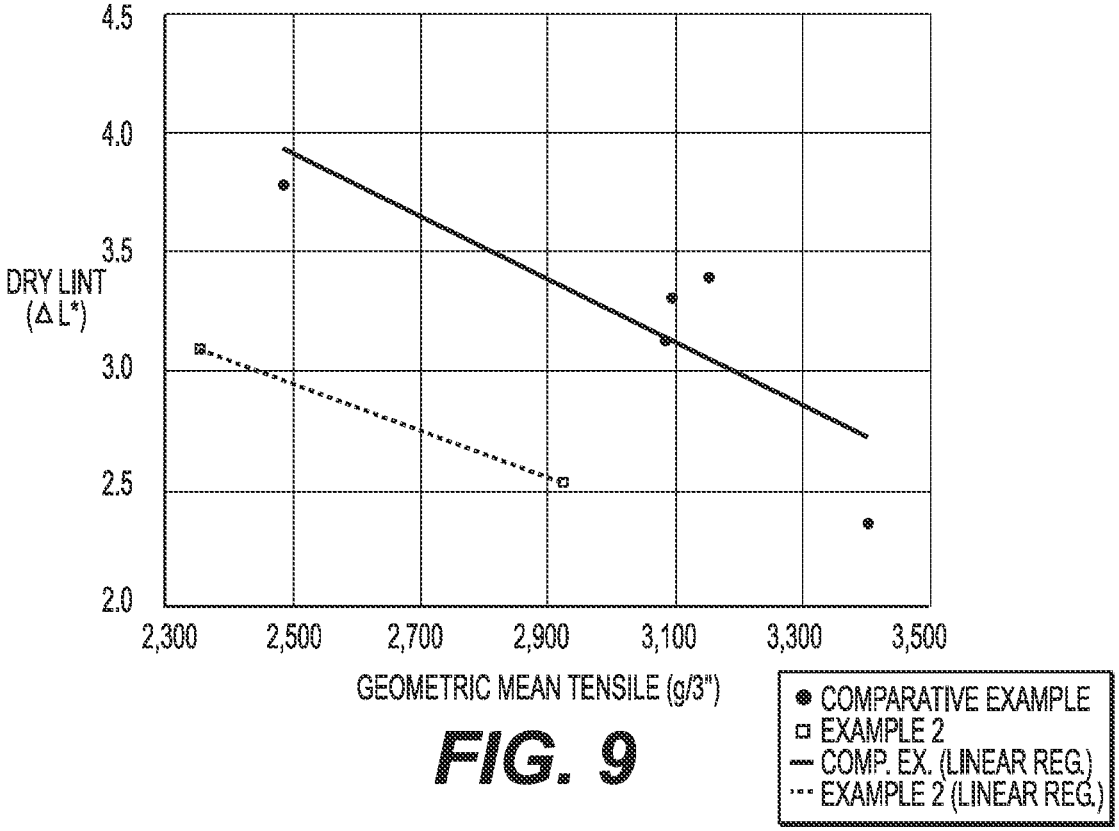
FIG. 9 is a plot of lint measurements (measured using the dry lint test) for the paper products of the comparative example and Example 2 as a function of geometric mean tensile strength.

The test results of the physical properties testing are shown in FIGS. 8 and 9 which plot the wet and dry lint, respectively, of the comparative example and Example 2 as a function of geometric mean tensile strength. A linear regression for each of the data sets is also shown in FIGS. 8 and 9. The results indicate that the wet lint values (FIG. 8) for the products in Example 2 were typically about twenty to thirty percent below those of the comparative example. A similar reduction in the dry lint values (FIG. 9) are also seen, where the products in Example 2 exhibited about twenty percent lower dry lint values than did the products of the comparative example.

Example 3

In the third example, the base sheets 110, 120 were produced using the same furnish, layering strategy, and wet-end chemistry as the comparative example, with the exception that a temporary wet strength agent (Kemira FennoRez 98 LS) was added in the Yankee layer 112, 122. The temporary wet strength agent was added to the Yankee layer 112, 122 at a rate of three pounds per ton. The temporary wet strength agent is in addition to the permanent wet-strength resin and CMC added to the Yankee layer 112, 122.

Figure 10:
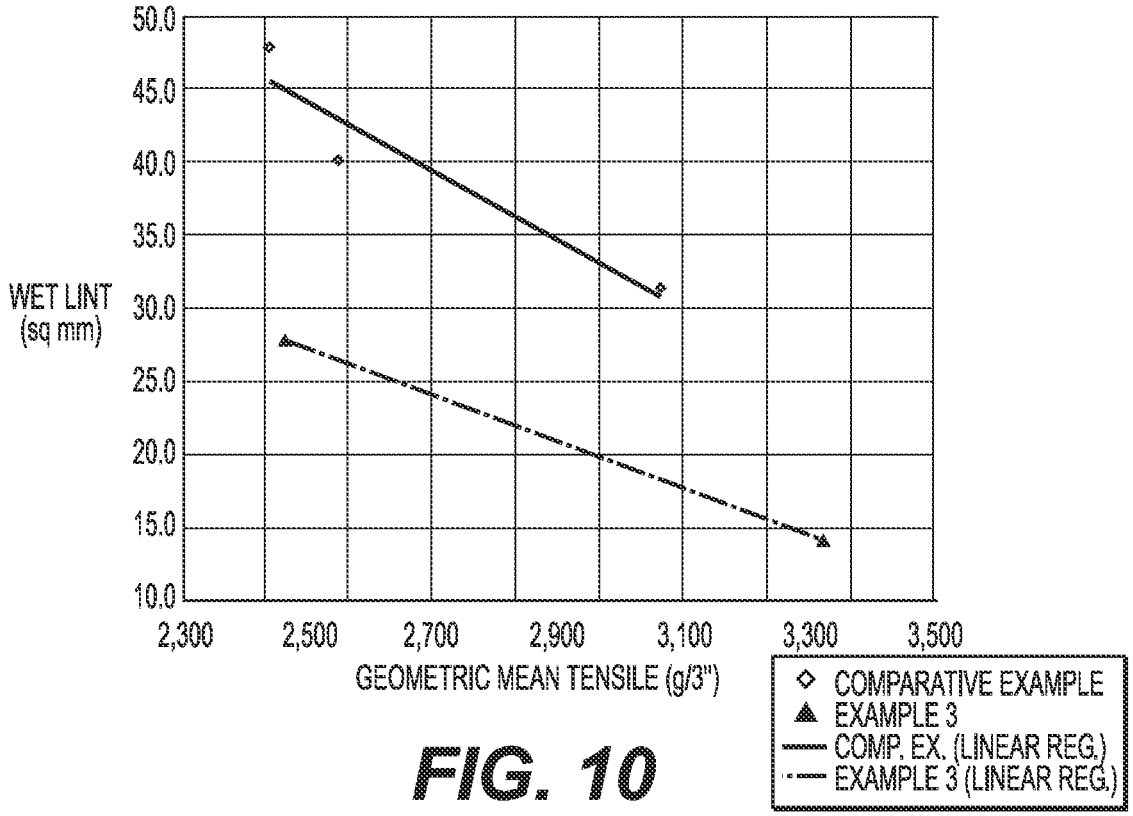
FIG. 10 is a plot of lint measurements (measured using the wet lint test) for the paper products of the comparative example and Example 3 as a function of geometric mean tensile strength.
Figure 11:
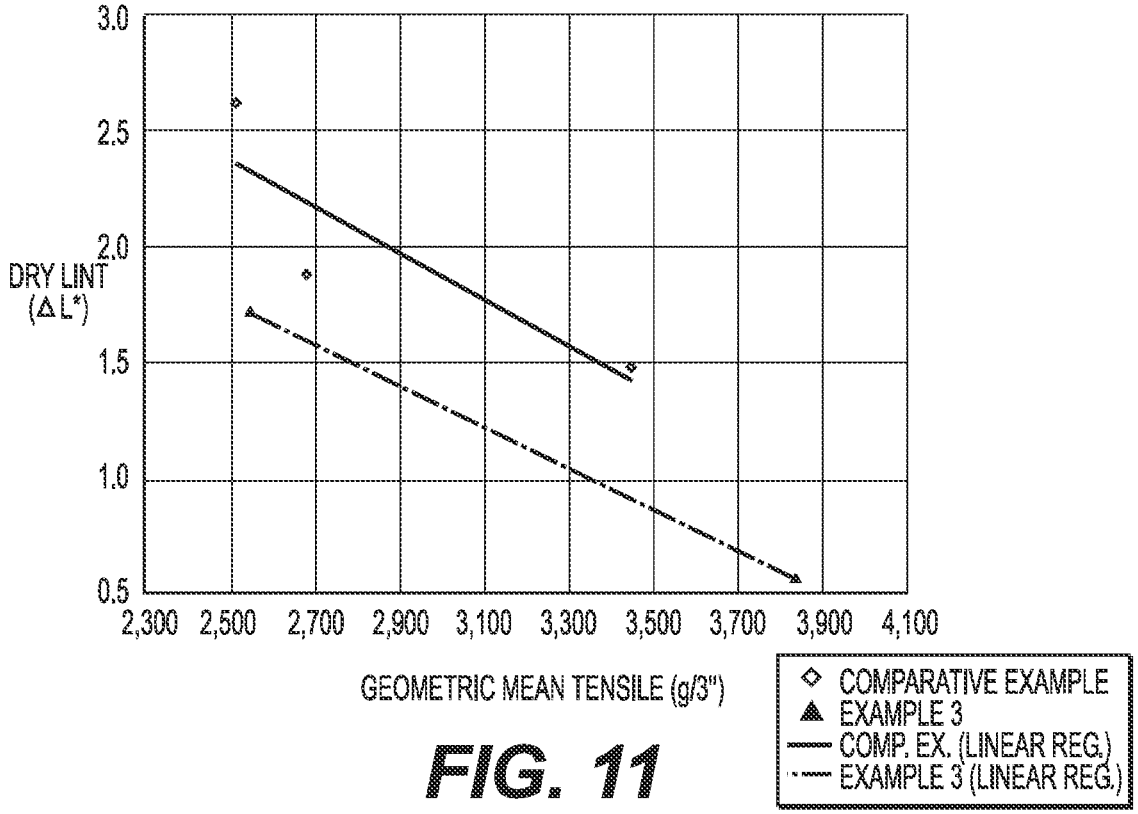
FIG. 11 is a plot of lint measurements (measured using the dry lint test) for the paper products of the comparative example and Example 3 as a function of geometric mean tensile strength.

The test results of the physical properties testing are shown in FIGS. 10 and 11 which plot the wet and dry lint, respectively, of the comparative example and Example 3 as a function of geometric mean tensile strength. A linear regression for each of the data sets is also shown in FIGS. 10 and 11. The results indicate that the use of a temporary wet strength agent in the Yankee layer 112, 122 reduced wet lint (FIG. 10) below the level seen for a similar product that did not include the temporary wet strength agent by thirty to forty percent. For dry lint values (FIG. 11), the reduction in lint generated was typically in the range of twenty-five percent.

Example 4

In the fourth example, the base sheets 110, 120 had the same composition and were produced in the same way as the comparative example, with the only substantial difference between the comparative example and the base sheets 110, 120 produced in Example 4 being the creping chemistry. The base sheets 110, 120 produced in Example 4 employed the same creping chemistry package, except that a creping chemistry modifying agent was included at an add-on rate of two and four-tenths milligrams per meter squared to reduce the adhesion between the base sheet 110, 120 and the Yankee drum 242.

Figure 12:
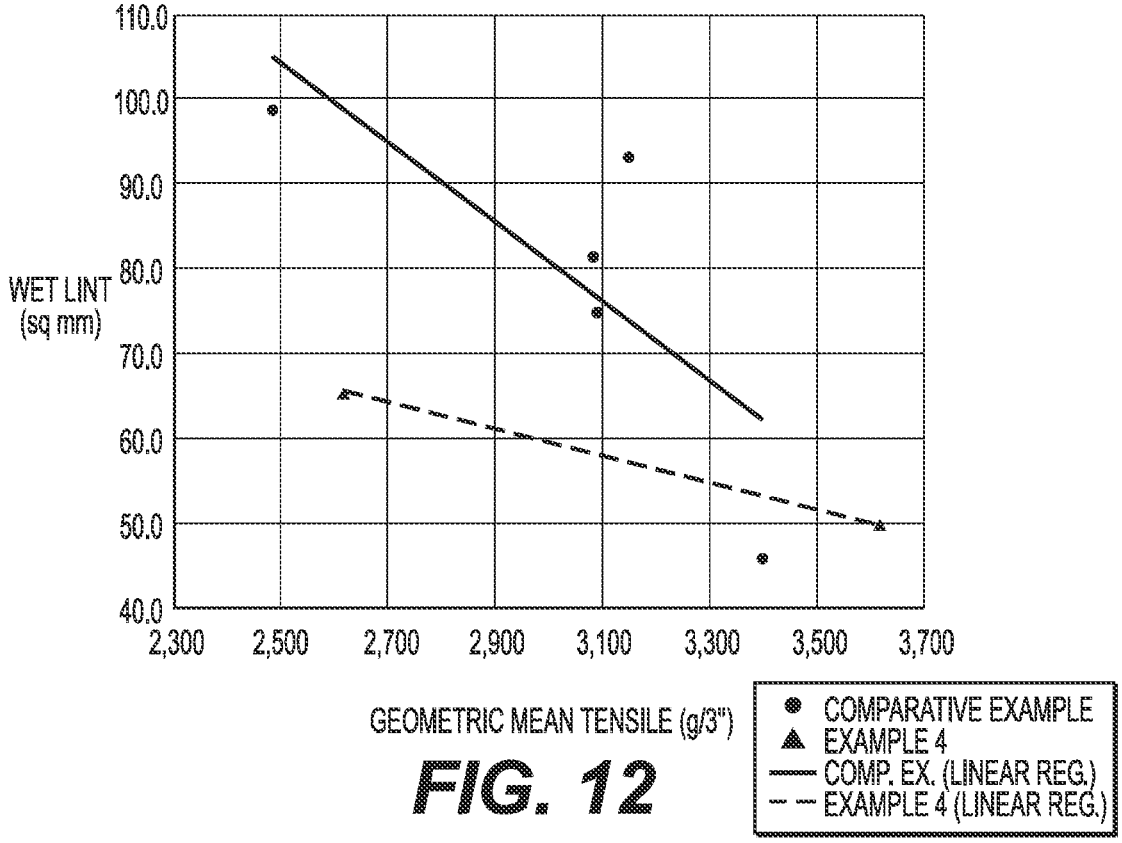
FIG. 12 is a plot of lint measurements (measured using the wet lint test) for the paper products of the comparative example and Example 4 as a function of geometric mean tensile strength.
Figure 13:
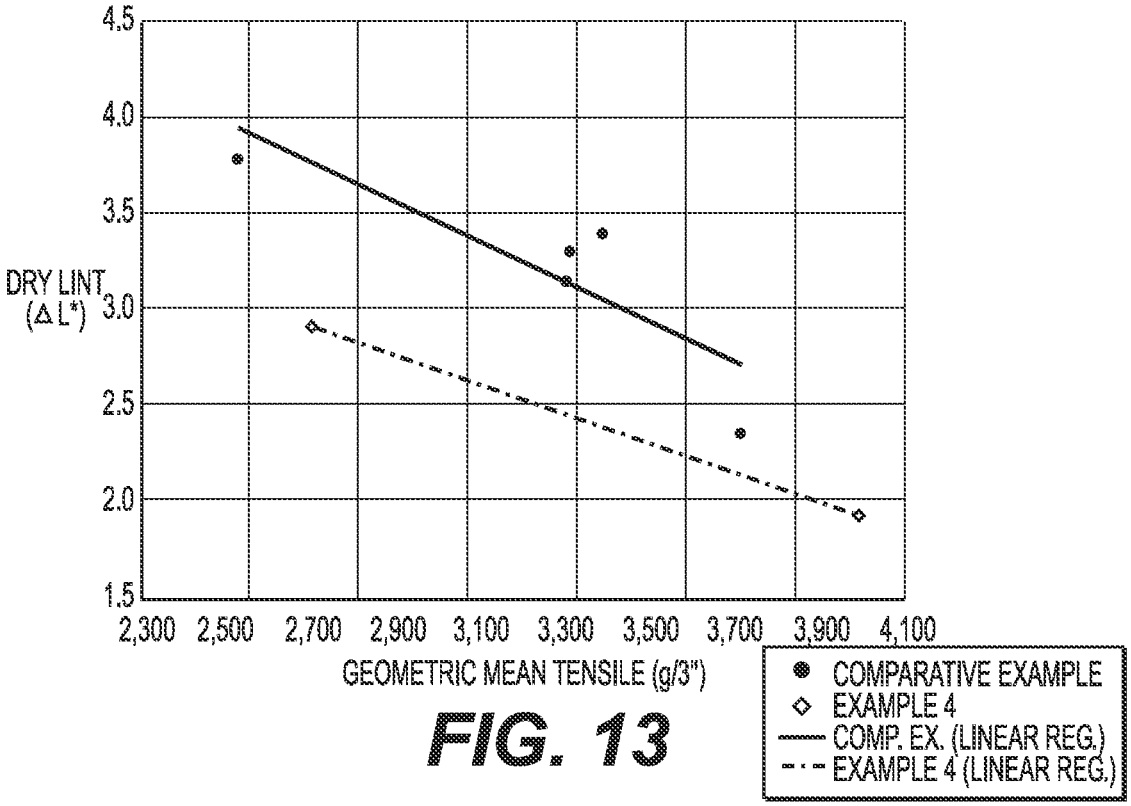
FIG. 13 is a plot of lint measurements (measured using the dry lint test) for the paper products of the comparative example and Example 4 as a function of geometric mean tensile strength.

The test results of the physical properties testing are shown in FIGS. 12 and 13 which plot the wet and dry lint, respectively, of the comparative example and Example 4 as a function of geometric mean tensile strength. A linear regression for each of the data sets is also shown in FIGS. 12 and 13. FIG. 12 shows the wet lint values and illustrates that the use of the additional creping chemistry modifying agent reduced the wet lint, with the reductions being in the range of twenty to thirty percent. The reduction in finished product dry lint, which is shown in FIG. 13, was typically in the range of fifteen to twenty percent.

Example 5

In the fifth example, the base sheets 110, 120 had the same composition and were produced in the same way as the modified comparative example, with the only substantial difference between the modified comparative example and the base sheets 110, 120 produced in Example 5 being the bevel of the creping blade. As discussed above, the modified comparative example is the same as the comparative example but manufactured using a different structuring fabric 342. The creping blade used in manufacturing the modified comparative example had a bevel of fifteen degrees (an angle θ of seventy-five degrees) and the base sheets 110, 120 produced in Example 5 had a bevel of thirty degrees (an angle θ of sixty degrees).

Figure 14:
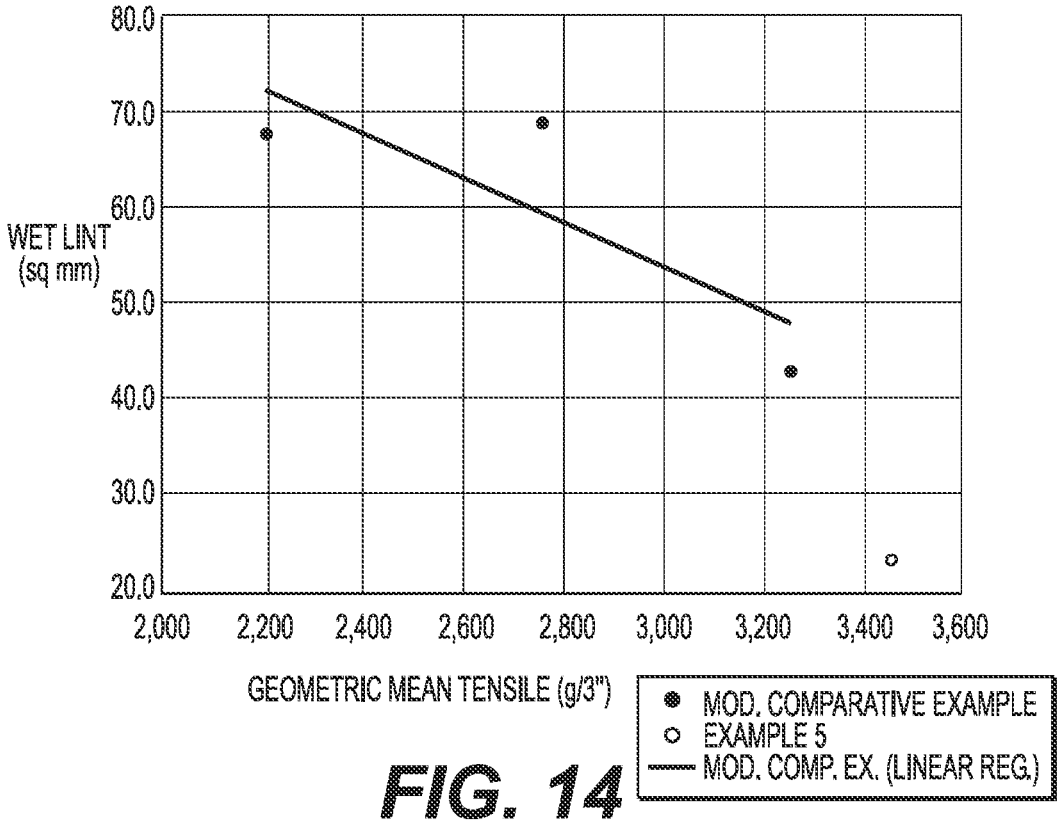
FIG. 14 is a plot of lint measurements (measured using the wet lint test) for the paper products of the modified comparative example and Example 5 as a function of geometric mean tensile strength.
Figure 15:
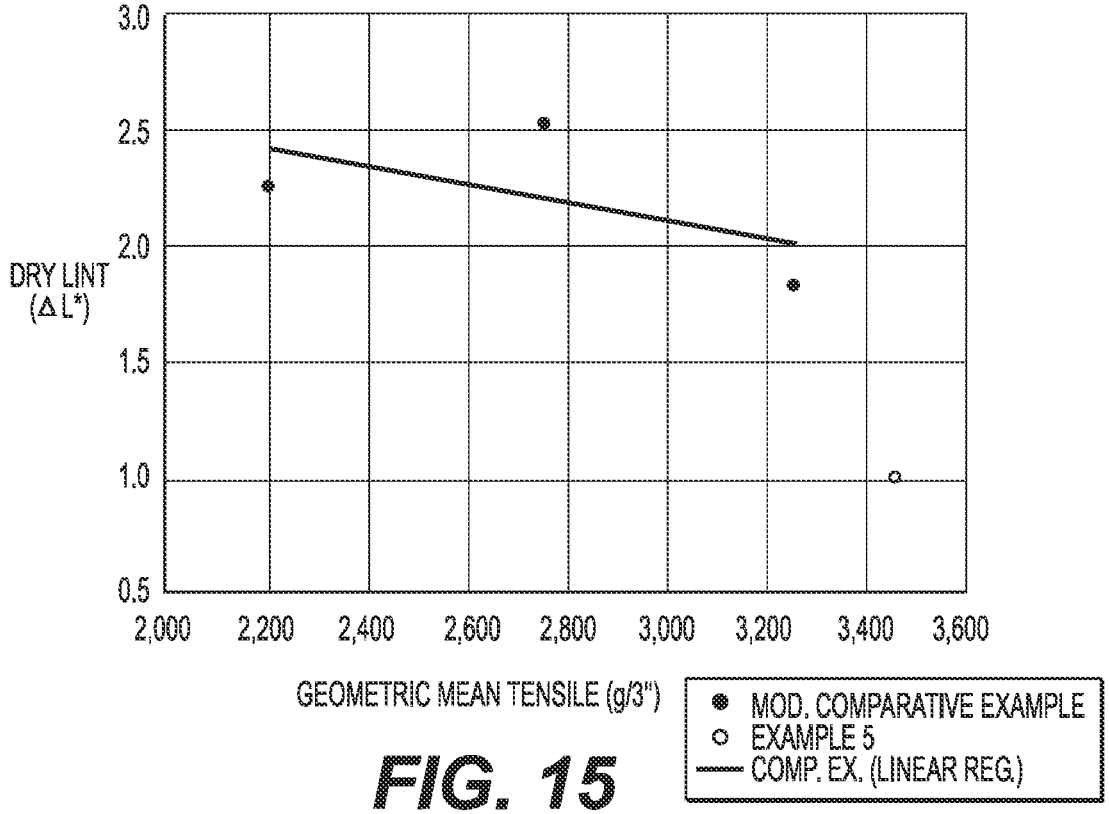
FIG. 15 is a plot of lint measurements (measured using the dry lint test) for the paper products of the modified comparative example and Example 5 as a function of geometric mean tensile strength.

The test results of the physical properties testing are shown in FIGS. 14 and 15 which plot the wet and dry lint, respectively, of the modified comparative example and Example 5 as a function of geometric mean tensile strength. A linear regression for modified comparative example is also shown in FIGS. 14 and 15. The test results indicate that increasing the creping angle by fifteen degrees decreased wet lint by about forty percent and reduced dry lint by forty to fifty percent.

Dry Lint Test

The following is a brief summary of the dry lint test used to evaluate the examples above. Although the following test method reference paper towels, this method may be suitably used for other paper products such as bathroom tissue, for example. Paper towel samples are preconditioned and conditioned according to Standard Test Method TAPPI TM-402. Preferably, a roll of paper towel is placed in an environment under a standard conditioning and testing atmosphere of seventy-two degrees and fifty percent relative humidity for two hours.

Test samples are then cut from the roll of the paper towel with a paper cutter. From each sample to be tested, four test squares are cut with the top side up. These test squares are four and a half inches by four and a half inches. From the test squares, test strips are prepared by stacking the four test squares and cutting the test squares in half (in the machine direction) to result in two stacks of four test strips that are two and a quarter inches by four and a half inches.

Two strips of black felt are also prepared. These strips are two and a half inches by six inches with the six-inch length being in machine direction of the felt. Any suitable black felt may be used including felts available from Aetna Felt Corporation of Allentown, Pa. A spectrophotometer should be used to take an initial (before test) L* measurement of the black felt. Any suitable spectrophotometer may be used, including, for example, a Gretag Macbeth model 3100 made by Gretag Macbeth of New Windsor, N.Y. (acquired by X-Rite Pantone of Grand Rapids, Mich.).

A rub tester is used to perform the dry lint test. Any suitable rub tester may be used including a SUTHERLAND® 2000™ rub tester available from the Danilee Company of San Antonio, Tex. The specimen is taped to the galvanized plate of the rub tester with the top side up so that rubbing will be in the machine direction. The black felt is taped to the bottom of a four pound rub block. Four strokes of the rub tester rubbing the felt against the specimen is then conducted at a speed of forty-two cycles per minute.

An after test L* measurement is be made on the back felt using the spectrophotometer. The same area on the back felt measured for the initial L* measurement should be measured for the after test L* measurement. The difference in L* between the before and after test measurement is reported to indicate the amount of lint produced. In FIGS. 7, 9, 11, 13, and 15, this difference is reported as A L*.

Although this invention has been described in certain specific exemplary embodiments, many additional modifications and variations would be apparent to those skilled in the art in light of this disclosure. It is, therefore, to be understood that this invention may be practiced otherwise than as specifically described. Thus, the exemplary embodiments of the invention should be considered in all respects to be illustrative and not restrictive, and the scope of the invention to be determined by any claims supportable by this application and the equivalents thereof, rather than by the foregoing description.

INDUSTRIAL APPLICABILITY

This invention can be used to produce desirable paper products, such as paper towels. Thus, this invention is applicable to the paper products industry.

We claim:

1. A method of making a multi-ply fibrous sheet, the method comprising:

providing, from a first furnish including a primary pulp having papermaking fibers, a first ply including a first stratified base sheet, the first stratified base sheet having at least two layers, one of the at least two layers being an inner layer, and another of the at least two layers being an outer layer comprising papermaking fibers, at least about eighty percent of the papermaking fibers in the outer layer being softwood fibers, the softwood fibers of the outer layer having (i) a weight-weighted average fiber length between about two and seven tenths millimeters and about three millimeters and (ii) a coarseness of about sixteen milligrams per one hundred meters or lower, the outer layer including a wet strength resin and the inner layer being substantially free of the wet strength resin;

providing, from a second furnish including a pulp having papermaking fibers, a second ply including a second stratified base sheet, the second stratified base sheet having at least two layers, one of the at least two layers being an inner layer, and another of the at least two layers being an outer layer comprising papermaking fibers, at least about eighty percent of the papermaking fibers in the outer layer being softwood fibers, the softwood fibers of the outer layer having (i) a weight-weighted average fiber length between about two and seven tenths millimeters and about three millimeters and (ii) a coarseness of about sixteen milligrams per one hundred meters or lower, the outer layer including a wet strength resin and the inner layer being substantially free of the wet strength resin;

forming a nascent web having at least two layers by arranging the first ply and the second ply such that the inner layer of the first ply is adjacent to the inner layer of the second ply and the inner layer of the first ply is attached to the inner layer of the second ply;

dewatering the nascent web to form a dewatered web;

applying the surface layer of the dewatered web to the outer surface of a Yankee drum of a Yankee dryer; and drying the dewatered web with the Yankee dryer to form the multi-ply fibrous sheet, wherein the multi-ply fibrous sheet has a cross machine direction (CD) wet/dry tensile ratio between about twenty-five hundredths and about thirty-five hundredths.

2. The method of claim 1, wherein the papermaking fibers of the primary pulp are refined.

3. The method of claim 1, wherein the first furnish further includes a secondary pulp, the secondary pulp having papermaking fibers, the papermaking fibers of the secondary pulp being the remainder of the papermaking fibers in the first furnish.

4. The method of claim 3, wherein the papermaking fibers of the primary pulp are refined and the papermaking fibers of the secondary pulp are unrefined.

5. The method of claim 1, wherein the papermaking fibers of the primary pulp have a weight-weighted average fiber length between about two and seven tenths millimeters and about two and ninety-five hundredths millimeters.

6. The method of claim 1, wherein the papermaking fibers of the primary pulp have a coarseness of about fifteen milligrams per one hundred meters or lower.

7. The method of claim 1, wherein the papermaking fibers of the primary pulp have a coarseness of about fourteen milligrams per one hundred meters or lower.

8. The method of claim 1, wherein the papermaking fibers of the primary pulp are at least ninety-five percent of the papermaking fibers of the first furnish.

9. The method of claim 1, wherein the papermaking fibers of the primary pulp are all of the papermaking fibers of the first furnish.

10. The method of claim 1, wherein the first furnish further includes a permanent wet strength resin.

11. The method of claim 10, wherein the first furnish includes between about five pounds per ton to about twenty pounds per ton of permanent wet strength resin.

12. The method of claim 10, wherein the first furnish includes between about eight pounds per ton to about sixteen pounds per ton of permanent wet strength resin.

13. The method of claim 10, wherein the first furnish further includes a temporary wet strength resin.

14. The method of claim 1, wherein the second furnish is substantially free of the wet strength resin.

15. The method of claim 1, further comprising providing a third furnish including paper making fibers, a third one of the at least two layers being formed from the third furnish, the third layer being located between the first and second layers.

16. A method of making a multi-ply fibrous sheet, the method comprising:

providing, from a first furnish including a primary pulp having papermaking fibers, a first ply including a first stratified base sheet, the first stratified base sheet having at least two layers, one of the at least two layers being an inner layer, and another of the at least two layers being an outer layer comprising papermaking fibers, less than about twenty percent of the papermaking fibers in the outer layer being hardwood fibers and the remainder being northern softwood fibers, the outer layer including a wet strength resin and the inner layer being substantially free of the wet strength resin;

providing, from a second furnish including a pulp having papermaking fibers, a second ply including a second stratified base sheet, the second stratified base sheet having at least two layers, one of the at least two layers being an inner layer, and another of the at least two layers being an outer layer comprising papermaking fibers, less than about twenty percent of the papermaking fibers in the outer layer being hardwood fibers and the remainder being northern softwood fibers, the outer layer including a wet strength resin and the inner layer being substantially free of the wet strength resin;

forming a nascent web having at least two layers by arranging the first ply and the second ply such that the inner layer of the first ply is adjacent to the inner layer of the second ply and the inner layer of the first ply is attached to the inner layer of the second ply;

dewatering the nascent web to form a dewatered web;

applying the surface layer of the dewatered web to the outer surface of a Yankee drum of a Yankee dryer; and drying the dewatered web with the Yankee dryer to form the multi-ply fibrous sheet, wherein the multi-ply fibrous sheet has a cross machine direction (CD) wet/dry tensile ratio between about twenty-five hundredths and about thirty-five hundredths.

17. The method of claim 16, wherein less than about ninety-five percent of the papermaking fibers in the aqueous slurry of papermaking fibers forming the surface layer are hardwood fibers.

18. The method of claim 16, wherein the papermaking fibers in the aqueous slurry of papermaking fibers forming the surface layer are about one hundred percent northern softwood fibers.

19. The method of claim 16, wherein the northern softwood fibers in the aqueous slurry of papermaking fibers forming the surface layer have a weight-weighted average fiber length between about two and seven tenths millimeters and about three millimeters.

20. The method of claim 19, wherein the northern softwood fibers in the aqueous slurry of papermaking fibers forming the surface layer have a coarseness of about sixteen milligrams per one hundred meters or lower.

21. The method of claim 19, wherein the northern softwood fibers in the aqueous slurry of papermaking fibers forming the surface layer have a coarseness of about fifteen milligrams per one hundred meters or lower.

22. The method of claim 19, wherein the northern softwood fibers in the aqueous slurry of papermaking fibers forming the surface layer have a coarseness of about fourteen milligrams per one hundred meters or lower.

23. The method of claim 16, wherein the northern softwood fibers in the aqueous slurry of papermaking fibers forming the surface layer have a weight-weighted average fiber length between about two and seven tenths millimeters and about two and ninety-five hundredths millimeters.

24. The method of claim 23, wherein the northern softwood fibers in the aqueous slurry of papermaking fibers forming the surface layer have a coarseness of about sixteen milligrams per one hundred meters or lower.

25. The method of claim 23, wherein the northern softwood fibers in the aqueous slurry of papermaking fibers forming the surface layer have a coarseness of about fifteen milligrams per one hundred meters or lower.

26. The method of claim 23, wherein the northern softwood fibers in the aqueous slurry of papermaking fibers forming the surface layer have a coarseness of about fourteen milligrams per one hundred meters or lower.

27. The method of claim 23, wherein the northern softwood fibers in the aqueous slurry of papermaking fibers forming the surface layer are refined northern softwood fibers.

28. The method of claim 27, wherein the hardwood fibers in the aqueous slurry of papermaking fibers forming the surface layer are unrefined hardwood fibers.

29. The method of claim 16, wherein the surface layer is less than about fifty percent, by weight, of the respective base sheet.

30. The method of claim 16, wherein the surface layer is from about thirty percent to about forty-five percent, by weight, of the respective base sheet.

31. The method of claim 16, wherein the aqueous slurry of papermaking fibers forming the surface layer further includes a wet strength resin.

32. The method of claim 16, further comprising providing a third furnish including paper making fibers, a third one of the at least two layers being formed from the third furnish, the third layer being located between the first and second layers.

* * * * *